US006133217A

United States Patent [19]

Lewis et al.

[11] Patent Number: 6,133,217

[45] Date of Patent: Oct. 17, 2000

[54] SOLUBILIZATION OF LOW 2-PHENYL ALKYLBENZENE SULFONATES

[75] Inventors: Ronald G. Lewis; David C. Lewis, both of Austin, Tex.

[73] Assignee: Huntsman Petrochemical Corporation, Austin, Tex.

[21] Appl. No.: 09/141,660

[22] Filed: Aug. 28, 1998

[51] Int. Cl.[7] ..... C11D 17/00; C11D 17/08

[52] U.S. Cl. ..... 510/351; 510/421; 510/424; 510/426; 510/427; 510/432

[58] Field of Search ..... 510/351, 421, 510/424, 426, 427, 432

[56] References Cited

U.S. PATENT DOCUMENTS

| | | | |
|---|---|---|---|
| 3,349,141 | 10/1967 | Sweeney | 260/668 |
| 3,776,962 | 12/1973 | Alul et al. | 260/624 C |
| 3,951,960 | 4/1976 | Heath et al. . | |
| 3,980,713 | 9/1976 | Matsunaga et al. . | |
| 3,985,687 | 10/1976 | Inamorato et al. | 252/551 |
| 3,993,659 | 11/1976 | Meyer . | |
| 4,028,283 | 6/1977 | Murata et al. . | |
| 4,224,840 | 9/1980 | Straw | 252/540 |
| 4,244,840 | 1/1981 | Straw . | |
| 4,301,317 | 11/1981 | Young | 585/455 |
| 4,396,520 | 8/1983 | Payne et al. | 252/89.1 |
| 4,618,446 | 10/1986 | Haslop et al. . | |
| 4,645,623 | 2/1987 | Dolan et al. | 252/558 |
| 4,663,069 | 5/1987 | Llenado | 252/117 |
| 4,668,423 | 5/1987 | Drozd et al. . | |
| 4,687,593 | 8/1987 | Dolan et al. | 252/182 |
| 4,692,271 | 9/1987 | Messenger et al. . | |
| 4,746,461 | 5/1988 | Zielske . | |
| 4,753,754 | 6/1988 | Messenger et al. . | |
| 4,760,200 | 7/1988 | Keen et al. . | |
| 4,973,780 | 11/1990 | Johnson et al. | 585/467 |
| 5,034,564 | 7/1991 | Kocal | 585/467 |
| 5,086,193 | 2/1992 | Sy | 585/446 |
| 5,146,026 | 9/1992 | Berna Tejero et al. | 585/467 |
| 5,147,576 | 9/1992 | Montague et al. . | |
| 5,152,933 | 10/1992 | Holland | 252/559 |
| 5,167,872 | 12/1992 | Pancheri et al. | 252/544 |
| 5,196,574 | 3/1993 | Kocal | 562/94 |
| 5,242,615 | 9/1993 | Urfer et al. . | |
| 5,256,828 | 10/1993 | Cuscurida et al. . | |
| 5,273,644 | 12/1993 | Wegerer | 208/66 |
| 5,344,997 | 9/1994 | Kocal | 568/628 |
| 5,415,814 | 5/1995 | Ofosu-Asante et al. | 252/558 |
| 5,446,223 | 8/1995 | Smith, Jr. et al. | 585/313 |
| 5,550,115 | 8/1996 | Garst et al. . | |
| 5,580,848 | 12/1996 | Drapier | 510/417 |
| 5,631,205 | 5/1997 | Killick et al. . | |
| 5,703,028 | 12/1997 | Erilli et al. . | |
| 5,716,925 | 2/1998 | Mondin et al. | 510/365 |
| 5,719,118 | 2/1998 | Crutcher et al. . | |
| 5,780,417 | 7/1998 | Gorlin | 510/426 |

FOREIGN PATENT DOCUMENTS

| | | |
|---|---|---|
| 0038101 | 10/1981 | European Pat. Off. . |
| 0113978 | 12/1983 | European Pat. Off. . |
| 0151884 | 8/1985 | European Pat. Off. . |
| 0160144 | 11/1985 | European Pat. Off. . |
| 0160145 | 11/1985 | European Pat. Off. . |
| 0353813 | 2/1990 | European Pat. Off. . |
| 0633307 A1 | 7/1994 | European Pat. Off. . |
| WO 93/00317 | 1/1993 | WIPO . |
| WO 95/31528 | 11/1995 | WIPO . |
| WO 97/04064 | 2/1997 | WIPO . |
| WO 97/39089 | 10/1997 | WIPO . |
| WO 97/39095 | 10/1997 | WIPO . |
| WO 97/47717 | 12/1997 | WIPO . |
| WO 98/00509 | 1/1998 | WIPO . |
| WO 98/46721 | 10/1998 | WIPO . |

OTHER PUBLICATIONS

Alberty and Daniels, Physical Chemistry, 5th Ed., pp. 616–617 *NMA.

Hawley's Condensed Chemical Dictionary ,11th Ed., p. 705 *NMA.

Clint, Surfactant Aggregation, pp. 160–170; 1992 *NMA.

Christian and Scamehorn, Solubilization in Surfactant Aggregates, pp. 118–120; 1995 *NMA.

Brown et al., "Poly(ethylene oxide)–sodium dodecyl sulfate interactions studied using static dynamic light scattering," *Macromolecules*, 25:7192–7198, Sep. 1992.

Cohen et al., "Influence of 2–phenyl alkane and tetralin content on solubility and viscosity of linear alkylbenzene sulfonate," *JAOCS*, 72(1):115–122, 1995, #NMA.

Contractor et al., "Interaction of PEO–PS–PEO block copolymers with ionic surfactants in aqueous solution," *Pure Appl. Chem.*, A34(12):2497–2507, 1997, #NMA.

Cox and Smith, "Effect of LAB composition on LAS performance," *INFORM*, 8(1):19–24, Jan. 1997.

de Ameida et al., "Linear alkylbenzene," *JAOCS*, 71(7):675–693, Jun. 1994.

Drozd, "An introduction to light duty (dishwashing) liquids Part I. Raw materials," *Chemical Times & Trends*, pp. 29–57, 1984, #NMA.

Drozd and Gorman, "Formulating characteristics of high and low 2–phenyl linear alkylbenzene sulfonates in liquid detergents," *JOACS*, 65(3):398–404, 1988, #NMA.

"Formulating Characteristics of High and Low 2–Phenyl Linear Alkylbenzene Sulfonates in Liquid Detergents," Presented at 77th Annual AOCS Meeting, May 17, 1986, Honolulu, HI by Stepan Company, Northfield, IL.

Friberg and Chiu, "Hydrotropes," *J. Dispersion Sci. Technol.*, 9(5&6):443–457, 1988–89 #NMA.

(List continued on next page.)

*Primary Examiner*—Necholus Ogden
*Attorney, Agent, or Firm*—O'Keefe, Egan & Peterman

[57] ABSTRACT

Methods and compositions relating to solubilization of alkylbenzene sulfonate surfactants in detergent formulations. Addition of one or more ethylene oxide/propylene oxide block copolymers to detergents including alkylbenzene sulfonate surfactants may be used to increase solubility of the alkylbenzene sulfonate surfactants. Increased solubility of the alkyl benzene sulfonate surfactants serves to lower the cloud point of the detergents permitting, for example, the formulation of liquid detergent compositions containing greater concentrations of low 2-phenyl linear alkylbenzene sulfonate surfactants.

43 Claims, No Drawings

OTHER PUBLICATIONS

Goddard, "Polymer–surfactant interaction Part I. Uncharged water–solublel polymers and charged surfactants," *Colloids and Surfaces*, 19:255–300, 1986, #NMA.
Gorlin et al., "Liquid automatic dishwasher detergents," *In: Liquid Detergents*, Kuo–Yann Lai (Ed.), Marcel Dekker, Inc., NY, Chapter 9, pp. 325–380, 1997, #NMA.
Huntsman brochure entitled: "Surfactants: A complete line of specialty surfactants and intermediates," 1996, #NMA.
Huntsman brochure entitled: "Surfactants: Detergents," 1996, #NMA.
Huntsman brochure entitled: "Surfactants: Linear Alkylbenzenes Alkylate 215, 225 & 229," 1996, #NMA.
Huntsman brochure entitled: "Surfactants: Product flow chart," 1998, #NMA.
Huntsman Technical Bulletin, ALKYLATE 215, 1997, #NMA.
Huntsman Technical Bulletin, ALKYLATE 225, 1997, #NMA.
Huntsman Technical Bulletin, ALKYLATE 229, 1997, #NMA.
Huntsman Surfactant Application Notes, vol. 2, POGOL™Polyethylene Glycols, 1997, NMA.
Huntsman Technical Bulletin, Surfonic®POA–L42, 1997, #NMA.
Huntsman Technical Bulletin, Surfonic®POA–L44, 1997, #NMA.
Huntsman Technical Bulletin, Surfonic®POA–L61, 1997, #NMA.
Huntsman Technical Bulletin, Surfonic®POA–L62, 1997, #NMA.
Huntsman Technical Bulletin, Surfonic®POA–L62LF, 1997, #NMA.
Huntsman Technical Bulletin, Surfonic®POA–L64, 1997, #NMA.
Huntsman Technical Bulletin, Surfonic®POA–L81, 1997, #NMA.
Huntsman Technical Bulletin, Surfonic®POA–L101, 1997, #NMA.
Huntsman Technical Bulletin, Surfonic®POA–25R2, 1997, #NMA.
Huntsman Technical Bulletin, POGOL™ 200 Polyethylene Glycol, 1997, #NMA.
Huntsman Technical Bulletin, POGOL™ 300 Polyethylene Glycol, 1997, #NMA.
Huntsman Technical Bulletin, POGOL™ 400 Polyethylene Glycol, 1997, #NMA.
Huntsman Technical Bulletin, POGOL™ 500 Polyehtylene Glycol, 1997, #NMA.
Huntsman Technical Bulletin, POGOL™ 600 Polyethylene Glycol, 1997, #NMA.
Huntsman Technical Bulletin, POGOL™ 900 Polyethylene Glycol, 1997, #NMA.
Huntsman Technical Bulletin, POGOL™ 1000 Polyethylene Glycol, 1997, #NMA.
Huntsman Technical Bulletin, POGOL™ 1005 Polyethylene Glycol, 1997, #NMA.
Huntsman Technical Bulletin, POGOL™ 1450 Polyethylene Glycol, 1997. #NMA.
Xia et al., "Complex formation between poly(oxyethylene) and sodium dodecyl sulfate micelles: light scattering, elecrophoresis, and dialysis equilibrium studies," *J. Phys. Chem.*, 96:6805–6811, Apr. 1992.
Jakobi and Löhr, In: *Detergents and Textile Washing: Principles and Practice*, Henkel KGaA, Düsseldorf, pp 41–107, 1987, #NMA.
Lai et al., "Light–duty liquid detergents," In: *Liquid Detergents*, Kuo–Yann Lai (Ed.), Marcel Dekker, Inc., NY, Chapter 7, pp. 207–260, 1997, NMA.
Loughney and Quencer, "Surfactants for high–performance cleaning," *Soap/Cosmetics/Chemical Specialties*, pp 24–30, Jan., 1992, #NMA.
Maltesh and Somasundaran, "Effect of binding of cations to polyethylene glycol on its interactions with sodium dodecyl sulfate," *Langmuir*, 8:1926–1930, Mar. 1992.
Matheson and Matson, "Effect of carbon chain and phenyl isomer distribution on use properties of linear alkylbenzene sulfonate: a comparison of'high' and 'low' 2–phenyl LAS homologs," *JAOCS*, 60(9):1693–1698, Jul. 1983.
Milwidsky, "Variations of Neutralizing Cations and Their Effects on Las Properties," *HAPPI*, pp 44, 48, Jan. 1984.
Moreno et al., "Influence of unsulfonated material and its sulfone content on the physical properties of linear alkylbenzene sulfonates," *JAOCS*, 65(6):1000–1006, Jun. 1988.
Moreno et al., "Influence of structure and counterions on physicochemical properties of linear alkylbenzene sulfonates," *JAOCS*, 67(8):547–552, Aug. 1990.
Nace (Ed.), *In: Nonionic Surfactants: Polyoxyalkylene Block Copolymers*, vol. 60, Marcel Dekker, Inc., NY, 1996, #NMA.
*Pluronic & Tetronic Block Copolymer Surfactants*, BASF Catalogue, pp 1–29, 1989, #NMA.
Sachdev and Krishnan, "Heavy–duty liquid detergents," In: *Liquid Detergents*, Kuo–Yann Lai (Ed.), Marcel Dekker, Inc., NY, Chapter 8, pp. 261–324, 1997, #NMA.
Smith, "Impact of composition on the performance of sodium linear alkylbenzenesulfonate (NaLAS)," *JAOCS*, 74(7):837–845, May 1997.
Sweeney and Olson, "Performance of straigh–chain alkylbenzene sulfonates (LAS) in heavy–duty detergents," 41:815–822, Dec. 1964.
Tjepkema et al., "Relationship between the structure of phenyldodecane isomers and their performance as detergent base materials," *Fifth World Petroleum Congress*, Section IV–Paper 21, pp 237–243, 1959, #NMA.
van Os et al., "Alkylarenesulphonates: The effect of chemical structure on physico–chemical properties," *Tenside Surf. Det.*, 29(3):175–189, #NMA.
Co–pending U.S. Application No. 09/143,177 filed August 28, 1998 (HNTC:059).
Co–pending U.S. Application No. 08/598,692 filed Feb. 8, 1996 (HNSC:002).
"Surfactants Literature," 1999.
Akzo Nobel catalog entitled "Surface Chemistry: Industrial surfactants general catalog, nitrogen derivatives."
Friberg, "Microemulsions and micellar solutions," *Microemulsions Theory and Practice*, p. 133–134.
Huntsman brochure entitled "Surfactants: SURFONIC® Alcohol Ethoxylates," 1996.
Huntsman brochure entitled "Surfactants: SURFONIC® Alkylphenol Ethoxylates," 1996.
Huntsman Technical Bulletin, SURFONIC® PEA–25, 1999.
Huntsman Technical Bulletin, SURFONIC® T–15, 1999.
Kirk–Othmer ed. "Microemulsions," *Ency. of Chem. Tech.*, Supplement Volume, pp. 299–303.
Kirk–Othmer ed. "Surfactants," *Ency. of Chem. Tech.*, 23:478–491.

Pillai and Shah, eds., *Dynamic Properties of Interfaces and Association Structures*, pp. 55, 127, 142, 156, 178, 179, 183, 194, 196, 233, 264.
Prince, "Schulman's microemulsions," *Microemulsions Theory and Practice*, p. 1–4, 8–9, 17–18, 113–114, 116.
Rosano and Clausse, eds., *Microemulsion Systems*, p. 280.
Stepan brochure entitled "Your complete surfactant source."
Tomah Products, Inc. brochure entitled "The Chemistry of Tomah Products, Inc."
Witco brochure entitled "Fabric Care: Surfactant & Specialty Products," 1996.
Co–pending U.S. Application No. 09/303,096 dated Apr. 29, 1999.
Blease et al., *In: Defoaming Theory and Industrial Applications*, P.R. Garrett (Ed.), Ch. 8, pp. 299–323, 1993.
Co–Pending U.S. Provisional Application No. 60/115,408 filed Jan. 11, 1999 (HNTC:064PZ1).
Co–Pending U.S. Provisional Application No. 60/139,441 filed Jun. 15, 1999 (HNTC:064PZ2).
Co–Pending U.S. Provisional Patent Application Entitled "Concentrated Surfactant Blends," filed Jun. 30, 1999 (HNTC:066PZ1).
International Search Report for PCT/US99/19176.
International Search Report for PCT/US99/19588.

SOLUBILIZATION OF LOW 2-PHENYL ALKYLBENZENE SULFONATES

BACKGROUND OF THE INVENTION

1. Field of the Invention

The present invention relates generally to liquid cleanser compositions and, more particularly, to solubility enhancement of alkylbenzene sulfonates, such as low 2-phenyl alkylbenzene sulfonates in aqueous cleanser formulations by addition of ethylene oxide/propylene oxide block co-polymers to the formulation.

2. Description of Related Art

Linear alkylbenzene sulfonates ("LAS") are widely used surfactants in commercial cleanser products because of their effectiveness as detergents, ease of biodegradation, and relative low cost. Typically, linear alkylbenzene sulfonates are produced via sulfonation of linear alkylbenzene intermediates.

Linear alkylbenzene is typically manufactured on an industrial scale using one of two commercial processes which differ from one another primarily by virtue of the catalyst system employed. In this regard, one process employs an aluminum trichloride catalyst, while the other process uses a hydrogen fluoride catalyst. The two processes result in linear alkylbenzene products with different phenyl isomer distributions. For example, a typical phenyl isomer distribution for products of the aluminum trichloride process is about 30% 2-phenyl isomer and about 22% 3-phenyl isomer. In contrast, a typical phenyl isomer distribution for products of the hydrogen fluoride process is about 20% 2-phenyl isomer and about 20% 3-phenyl isomer, although reported values may differ. The product of the aluminum trichloride process, which is relatively high in 2-phenyl isomer content, is often referred to as "high 2-phenyl" linear alkylbenzene, whereas the product of the hydrogen fluoride process, which is relatively low in 2-phenyl isomer content, is often referred to as "low 2-phenyl" linear alkylbenzene.

The sulfonates of linear alkylbenzenes are known to exhibit different physical properties depending upon the position of the aromatic group on the alkyl chain. Therefore, high 2-phenyl linear alkylbenzene sulfonates have physical properties that differ from low 2-phenyl linear alkylbenzene sulfonates. For example, high 2-phenyl linear alkylbenzene sulfonates typically have a higher solubility in aqueous media than do low 2-phenyl linear alkylbenzene sulfonates. Furthermore, an aqueous solution comprising a high 2-phenyl linear alkylbenzene sulfonate may exhibit a higher viscosity than an aqueous solution comprising a low 2-phenyl linear alkylbenzene sulfonate. In cases where maximum solubility of linear alkylbenzene sulfonate in an aqueous detergent formulation is of concern, a product containing a relatively high percentage of compounds in which the aromatic substituent is in the 2 or 3 position and a correspondingly smaller percentage of isomers in which the aromatic substituent is positioned centrally with respect to the alkyl chain may be advantageous.

In the past, poor aqueous solubility has typically precluded the use of low 2-phenyl linear alkylbenzene sulfonates in detergent applications requiring a liquid formulation. For example, heavy duty liquid laundry detersive and liquid dishwashing detergent products have typically employed the more soluble high 2-phenyl linear alkylbenzene sulfonates as anionic surfactants. However, the relative high cost of high 2-phenyl surfactants often presents a disadvantage to cost-conscious detergent formulators and marketers. The higher cost of high 2-phenyl linear alkylbenzene sulfonates compared to low 2-phenyl surfactants stems from the greater expense associated with the aluminum trichloride process relative to the hydrogen fluoride process.

Attempts have been made to reduce the cost of liquid detergent formulations employing linear alkylbenzene sulfonates. Typically, these have included attempts to facilitate the use of the relatively less expensive low 2-phenyl linear alkyl benzene sulfonates. For example, one method typically employed for improving solubility of low 2-phenyl linear alkylbenzene sulfonates in liquid detergent formulations has involved the addition of hydrotropes, such as sodium xylene sulfonate. As used herein, the term "hydrotrope" is defined to be a compound that has the property of increasing the aqueous solubility of various slightly soluble organic chemicals. However, the cost advantage of low 2-phenyl formulations may be partially or completely offset by the cost of the relatively large amount of hydrotropes typically required to effect improved low 2-phenyl surfactant solubility without any accompanying improvement in the detergency characteristics of the formulation. Furthermore, addition of large amounts of hydrotropes to a detergent formulation may have the undesirable effect of lowering the viscosity of the detergent.

SUMMARY OF THE INVENTION

The disclosed method and compositions relate to enhanced or improved solubilization of low 2-phenyl alkylbenzene sulfonates in aqueous detergent formulations. Among other things, liquid surfactant compositions including low 2-phenyl linear alkylbenzene sulfonate surfactants are provided. In the practice of the disclosed method and compositions, addition of ethylene oxide/propylene oxide block co-polymers to surfactant compositions including low 2-phenyl linear alkylbenzene sulfonate surfactants surprisingly increases the solubility of the low 2-phenyl linear alkylbenzene sulfonates in aqueous solutions, resulting in lower cloud and clear points, and permitting formulation of liquid detergent compositions containing greater concentrations of relatively less expensive low 2-phenyl linear alkylbenzene sulfonates.

Advantageously, in the practice of the disclosed method, ethylene oxide/propylene oxide block co-polymers may be added to an aqueous surfactant composition containing low 2-phenyl linear alkylbenzene sulfonate to enhance the solubility of the low 2-phenyl linear alkylbenzene sulfonate. Solubility enhancements typically results in a lowering of the cloud and clear points of the composition. For example, the cloud point of a surfactant composition comprising water, sodium hydroxide, and a low 2-phenyl linear alkylbenzene sulfonate compound may typically be depressed below the freezing point of water (0° C.) or lower, depending upon the concentration of low 2-phenyl linear alkylbenzene sulfonate present and depending upon the amount of ethylene oxide/propylene oxide block co-polymer solubility enhancer added.

In the practice of the disclosed method, addition of ethylene oxide/propylene oxide block co-polymer compound/s to an aqueous surfactant composition lowers the cloud point of the composition typically to as low as about 15° C. to about −8° C., more typically to as low as from about 10° C. to about −6° C., and most typically to as low as from about 3° C. to about −5° C. Such a surfactant composition may also include a solvent in addition to water, such as an alcohol containing from 1 to about 6 carbon atoms. Such a surfactant composition may also include one or more solvents in addition to (or instead of) water, such as alcohols, glycols, glycol ethers, mixtures thereof, etc. Suitable alcohols include, but are not limited to, straight chain alkyl alcohols (including those containing from one to six carbon atoms, e.g., methanol, ethanol, n-propanol, n-hexanol, etc.), branched chain alkyl alcohols (including those containing from three to six carbon atoms, e.g., isopropanol and secondary butanol, etc.), glycols such as propylene glycol, diglycols such as dipropylene glycol and triglycols such as triethylene glycol and glycol ethers such as butylene glycol diethylether and dipropylene glycol methylether. Such solvents (when added in addition to water), are typically added in an amount of between about 1% and about 20%, alternatively between about 5% and about 15%, alternatively between about 10% and about 15% by total weight of the composition, although greater or lesser amounts of such solvents may also be suitably employed.

In one respect then, this invention is a surfactant composition including at least one alkylbenzene sulfonate; and at least one ethylene oxide/propylene oxide block co-polymer solubility enhancer; wherein the ethylene oxide/propylene oxide block co-polymer has a content of ethylene oxide greater than 15% by weight of the molecule. The ethylene oxide/propylene oxide block copolymer may have the formula:

$$HO[CH_2CH_2O][CH_2\overset{\overset{CH_3}{|}}{C}HO][CH_2CH_2O]H$$

In one embodiment, the alkylbenzene sulfonate may be a low 2-phenyl linear alkylbenzene sulfonate. The alkylbenzene sulfonate may be a linear alkylbenzene sulfonate having a 2-phenyl isomer content of less than or equal to 25% by weight. Alternatively, the alkylbenzene sulfonate may be a linear alkylbenzene sulfonate having a 2-phenyl isomer content of up to about 20% by weight. The surfactant composition may further include a solvent. The solvent may include at least one of water, alcohol, glycol, glycol ether, or mixture thereof. The solvent may include at least one of water, alcohol having from 1 to about 6 carbon atoms, or a mixture thereof. An alkyl chain of the linear alkylbenzene sulfonate may have from about 8 to about 16 carbon atoms. A cation of the alkylbenzene sulfonate may include, for example, at least one of ammonium, a substituted ammonium, an alkali metal, an alkaline earth metal, or a mixture thereof. Typically, the alkali metal includes sodium.

The alkylbenzene sulfonate may be present in an amount of from about 5% to about 30% by total weight of the composition, and the ethylene oxide/propylene oxide solubility enhancer may be present in an amount of from about 0.5% to about 10% by total weight of the composition. The alkylbenzene sulfonate may be present in an amount of from about 15% to about 30% by total weight of the composition, and the ethylene oxide/propylene oxide solubility enhancer may be present in an amount of from about 0.8% to about 8% by total weight of the composition. The ethylene oxide/propylene oxide block co-polymer may be present in a mole ratio from about 46:1 to about 4:1 relative to the low 2-phenyl alkylbenzene sulfonate. In one embodiment, the cloud point of the surfactant composition may be about 17° C. or lower, or alternatively from about 17° C. to about −10° C. In another embodiment, the clear point of a surfactant composition may be about 23° C. or lower, or alternatively from about 23° C. to about −5° C., or alternatively from about 23° C. to about −2° C. In still another embodiment, a sodium LAS surfactant composition may have a reduction in cloud point of between about 1I0° C. and about 38° C. when compared to a similar sodium LAS surfactant composition lacking the disclosed solubility enhancing ethylene oxide/propylene oxide block co-polymer. In still another embodiment, a sodium LAS surfactant composition may have a reduction in clear point of between about 5° C. and about 35° C. when compared to a similar sodium LAS surfactant composition lacking the disclosed solubility enhancing ethylene oxide/propylene oxide block co-polymer.

In another respect, this invention is a surfactant composition including a solvent and linear alkylbenzene sulfonate, the linear alkylbenzene sulfonate having a 2-phenyl isomer content of from about 14% to 25% by weight; and wherein the alkylbenzene sulfonate is present in an amount of from about 2% to about 40% by total weight of the composition; wherein the ethylene oxide/propylene oxide solubility enhancer is present in an amount of from about 0.2% to about 10% by total weight of the composition; wherein the ethylene oxide/propylene oxide block copolymer has an ethylene oxide content of from greater than about 15% to about 80% by weight of the copolymer molecule; and wherein the ethylene oxide/propylene oxide block copolymer has the formula:

$$HO[CH_2CH_2O][CH_2\overset{\overset{CH_3}{|}}{C}HO][CH_2CH_2O]H$$

The ethylene oxide/propylene oxide block copolymer may have an ethylene oxide content of from 20% to about 70% by weight of the molecule. The solvent may include at least one of water, alcohol, glycol, glycol ether, or a mixture thereof. The solvent may include at least one of water, alcohol having from 1 to about 6 carbon atoms, or a mixture thereof. The alkyl chain of the alkylbenzene sulfonate surfactant may contain from about 8 to about 16 carbon atoms. A cation of the alkylbenzene sulfonate surfactant may include at least one of ammonium, a substituted ammonium, an alkali metal, an alkaline earth metal, or a mixture thereof. Typically, the alkali metal includes sodium. The cloud point of the surfactant composition may be about 17° C. or lower, or alternatively from about 17° C. to about −10° C. The clear point of the surfactant solution may be about 23° C. or lower, or alternatively from about 23° C. to about −5° C., or alternatively from about 23° C. to about −2° C.

In still another embodiment, a sodium LAS surfactant composition may have a reduction in cloud point of between about 10° C. and about 38° C. when compared to a similar sodium LAS surfactant composition lacking the disclosed solubility enhancing ethylene oxide/propylene oxide block co-polymer/s. In still another embodiment, a sodium LAS surfactant composition may have a reduction in clear point of between about 5° C. and about 35° C. when compared to a similar sodium LAS surfactant composition lacking the disclosed solubility enhancing ethylene oxide/propylene oxide block co-polymer/s.

In yet another respect, this invention is a surfactant composition including from about 2% to about 40% low 2-phenyl linear alkylbenzene sulfonate by total weight of the composition; from about 0.2% to about 8% ethylene oxide/propylene oxide block co-polymer by total weight of the composition; and from about 97.8% to about 52% solvent by total weight of the composition; wherein the solvent includes at least one of water, alcohol containing from 1 to about 6 carbon atoms, or a mixture thereof; wherein an alkyl chain of the low 2-phenyl linear alkylbenzene sulfonate surfactant contains from about 8 to about 16 carbon atoms; and wherein the ethylene oxide/propylene oxide block copolymer may have an ethylene oxide content of from about 20% to about 80% by weight of the copolymer molecule, and a propylene oxide content of from about 20% to less than about 80% by weight of the copolymer molecule, and wherein the ethylene oxide/propylene oxide block copolymer may be represented by the formula:

$$HO[CH_2CH_2O][CH_2\overset{\overset{CH_3}{|}}{C}HO][CH_2CH_2O]H$$

The solvent may include water. In one embodiment, the cloud point of a surfactant composition, typically having a sodium cation, may be about 17° C. or lower, or alternatively from about 17° C. to about −10° C.; and/or the clear point of the surfactant composition may be about 23° C. or lower, or alternatively from about 23° C. to about −5° C., or alternatively from about 23° C. to about −2° C. In another embodiment, the disclosed surfactant composition may be a sodium LAS and have a reduction in cloud point of between about 10° C. and about 38° C.; or may have a reduction in clear point of between about 5° C. and about 35° C. when compared to a conventional sodium LAS without the disclosed solubility enhancing ethylene oxide/propylene oxide block co-polymer/s. A cation of the low 2-phenyl linear alkylbenzene sulfonate surfactant may include sodium.

In yet another respect, this invention is a method of enhancing solubility of alkylbenzene sulfonate in a surfactant composition including a solvent and alkylbenzene sulfonate, the method including the steps of: adding a ethylene oxide/propylene oxide block co-polymer solubility enhancer to the surfactant composition; wherein the ethylene oxide/propylene oxide block co-polymer may have a content of ethylene oxide greater than 15% by weight of the molecule. In one embodiment, the ethylene oxide/propylene oxide block copolymer may have the formula:

$$HO[CH_2CH_2O][CH_2\overset{\overset{CH_3}{|}}{C}HO][CH_2CH_2O]H$$

The alkylbenzene sulfonate may be a low 2-phenyl alkylbenzene sulfonate. The alkylbenzene sulfonate may have a 2-phenyl isomer content of less than or equal to 25% by weight. The alkylbenzene sulfonate may have a 2-phenyl isomer content of up to about 20% by weight. The solvent may include at least one of water, alcohol having from 1 to about 6 carbon atoms, glycols, glycol ethers, or a mixture thereof. In one embodiment, the solvent includes water. In one embodiment, the alkyl chain of the alkylbenzene sulfonate may have from about 8 to about 16 carbon atoms. The alkali metal may include sodium. In one embodiment, the ethylene oxide/propylene oxide block copolymer may have an ethylene oxide content of from greater than about 15% to about 80% by weight of the copolymer molecule. In another embodiment, the ethylene oxide/propylene oxide block copolymer may have an ethylene oxide content from about 20% to about 80% by weight of the copolymer molecule. In another embodiment, the ethylene oxide/propylene oxide block copolymer may have an ethylene oxide content from about 20% to about 70% by weight of the copolymer molecule. In one embodiment, the step of adding ethylene oxide/propylene oxide block co-polymer to the surfactant composition includes the step of adding a sufficient amount of ethylene oxide/propylene oxide block co-polymer to the surfactant composition to result in a surfactant composition including from about 2% to about 40% low 2-phenyl alkylbenzene sulfonate by total weight of the composition; and from about 0.2% to about 8% ethylene oxide/propylene oxide block co-polymer by total weight of the composition. In another embodiment, the step of adding includes: adding an ethylene oxide/propylene oxide to the surfactant composition, typically a sodium LAS-containing surfactant composition; and lowering the cloud point of the surfactant composition to about 17° C. or lower, or alternatively to from about 17° C. to about −10° C.; or lowering the clear point of the surfactant composition to about 23° C. or lower, or alternatively to from about 23° C. to about −5° C., or alternatively to from about 23° C. to about −2° C. In another embodiment, the step of adding includes: adding an ethylene oxide/propylene oxide to the surfactant composition, typically a sodium LAS-containing surfactant composition; and lowering the cloud point of the surfactant composition to between about 10° C. and about −7° C.; or reducing the clear point of the surfactant composition to between about 10° C. and about −1° C.

DETAILED DESCRIPTION OF ILLUSTRATIVE EMBODIMENTS

The disclosed method and compositions relate to enhanced or improved solubilization of low 2-phenyl alkylbenzene sulfonates in aqueous detergent formulations. Among other things, liquid surfactant compositions comprising low 2-phenyl linear alkylbenzene sulfonate surfactants are provided.

In the practice of the disclosed method and compositions, addition of ethylene oxide/propylene oxide block co-polymers to surfactant compositions including low 2-phenyl linear alkylbenzene sulfonates surprisingly increases solubility of low 2-phenyl linear alkylbenzene sulfonates in an aqueous solution. Advantageously, increased solubility of low 2-phenyl linear alkylbenzene sulfonates results in lower solution cloud points and clear points and permits formulation of liquid detergent compositions containing greater concentrations of relatively less expensive low 2-phenyl linear alkylbenzene sulfonate surfactants.

As used herein, the term "cloud point" is defined as the temperature at which a substantially clear solution becomes opaque or cloudy. As used herein, the term "clear point" is defined as the temperature at which an opaque or cloudy solution becomes substantially clear. In either case, a substantially clear solution is a solution isotropic in appearance in which insoluble material is not visually discernible in the solution. In this regard, cloud point and/or clear point may be used as an indicator of the mutual solubility of the components in an aqueous solution. In the case of many detergent formulations incorporating LAS, this indicates the solubility/insolubility of the LAS component. In this regard, cloud point and/or clear point may be used as an indicator of the solubility of anionic surfactants in aqueous solution. All other parameters being equal, a lower cloud point and/or clear point is indicative of greater solute solubility. As illustrated in the examples included herein, cloud and clear point determinations show that the addition of relatively low molecular weight ethylene oxide/propylene oxide block co-polymers surprisingly increases solubility of low 2-phenyl linear alkylbenzene sulfonates in aqueous solutions, such as heavy duty liquid laundry detergent formulations. Advantageously, ethylene oxide/propylene oxide block co-polymer solubility enhancers of the disclosed method and compositions are capable of depressing the cloud and clear points of low 2-phenyl linear alkylbenzene sulfonate surfactants to temperatures lower than the cloud point temperatures typically achieved by hydrotropes. Further advantageously, the solubility enhancing effect of the disclosed surfactant compositions is typically attained using ethylene oxide/propylene oxide block co-polymer concentrations lower than those concentrations required for hydrotropes.

The disclosed method and compositions are useful with all types of liquid surfactant compositions in which linear alkyl benzene sulfonates are present as a surfactant component. Examples of such liquid compositions include, but are not limited to, heavy duty laundry detergents, herbicide emulsifiers, hard surface cleaners, bathroom cleaners, all purpose cleaners, car wash detergents and janitorial cleaners and light duty liquid detergents. Surprisingly, in accordance with the present disclosure, ethylene oxide/propylene oxide block co-polymer materials may be used to improve solubility of low 2-phenyl linear alkyl benzene sulfonates. Significantly, ethylene oxide/propylene oxide block co-polymer materials have been shown to offer superior solubility enhancing qualities over conventional solubility enhancers such as amines and hydrotrope materials. The addition of ethylene oxide/propylene oxide block co-polymers, most typically relatively lower molecular weight ethylene oxide/propylene oxide block co-polymers, acts to reduce the cloud and clear points of low 2-phenyl linear alkyl benzene sulfonate materials to lower temperatures. Thus ethylene oxide/propylene oxide block co-polymers improve the solubility and applicability of low 2-phenyl linear alkyl benzene sulfonate materials in detergent formulations. The unexpected advantages of this method are the allowed use of low 2-phenyl linear alkyl benzene sulfonate products and/or the use of considerably higher levels of these products in liquid detergent formulations while retaining the desired stability and aesthetic properties of these formulations.

In the practice of the disclosed method and compositions, any low 2-phenyl alkylbenzene sulfonate compound/s or mixture thereof suitable for use in liquid detergent formulations may be employed. Typical low 2-phenyl alkyl benzene sulfonate compounds include, but are not limited to, those prepared by alkylating benzene with straight chain monoolefins in the presence of hydrogen fluoride as catalyst, followed by sulfonation with any suitable sulfonating agent.

For example, preparation of suitable low 2-phenyl alkylbenzene sulfonate compounds may include dehydrogenation of straight chain paraffins over a suitable catalyst, to provide a mixture containing the desired straight chain monoolefins as well as unreacted straight chain paraffins. This mixture may be passed to an alkylation unit wherein the straight chain monoolefins may be used to alkylate benzene to form the desired straight chain alkylbenzene compounds, as well as unreacted straight chain paraffins which may be readily separated therefrom by such procedures as distillation. Straight chain alkylbenzene compounds thus prepared may be sulfonated with any suitable sulfonating agent, such as sulfur trioxide, mixtures of sulfur dioxide and sulfur trioxide, chlorosulfonic acid, or the like, by conventional procedures. The resulting sulfonic acid may be neutralized with an alkali metal hydroxide or carbonate, such as potassium hydroxide or sodium carbonate, or by the use of any other suitable base conventionally employed in the preparation of ammonium or alkali metal salts of aryl sulfonic acids.

It will be understood that benefit of the disclosed method and compositions may be realized in solutions including any alkylbenzene sulfonate compounds, including those of varying molecular weights, alkyl chain length and alkyl chain phenyl location combination. Examples of such compounds are described in U.S. Pat. No. 3,776,962; U.S. Pat. No. 5,152,933; U.S. Pat. No. 5,167,872; Drazd, Joseph C. and Wilma Gorman, "Formulating Characteristics of High and Low 2-Phenyl Linear Alkylbenzene Sulfonates in Liquid Detergents," *JAOCS*, 65(3):398–404, March 1988; Sweeney, W. A. and A. C. Olson, "Performance of Straight-Chain Alkylbenzene Sulfonates (LAS) in Heavy-Duty Detergents," *JAOCS*, 41:815–822, December 1964.; Drazd, Joseph C., "An Introduction to Light Duty (Dishwashing) Liquids Part I. Raw Materials," *Chemical Times & Trends*, 29–58, January 1985; Cohen, L. et al., "Influence of 2-Phenyl Alkane and Tetralin Content on Solubility and Viscosity of Linear Alkylbenzene Sulfonate," *JAOCS*, 72(1):115–122, 1995; Smith, Dewey L., "Impact of Composition on the Performance of Sodium Linear Alkylbenzene-sulfonate (NaLAS)," *JAOCS*, 74(7):837–845, 1997; van Os, N. M. et al., "Alkylarenesulphonates: The Effect of Chemical Structure on Physico-chemical Properties," *Tenside Surf. Det.*, 29(3):175–189, 1992; Moreno, A. et al., "Influence of Structure and Counterions on Physicochemical Properties of Linear Alkylbenzene Sulfonates," *JAOCS*, 67(8):547–552, August 1990; Matheson, K. Lee and Ted P. Matson, "Effect of Carbon Chain and Phenyl Isomer Distribution on Use Properties of Linear Alkylbenzene Sulfonate: A Comparison of 'High' and 'Low' 2-Phenyl LAS Homologs," *JAOCS*, 60(9):1693–1698, September 1983; Cox, Michael F. and Dewey L. Smith, "Effect of LAB composition on LAS Performance," *INFORM*, 8(1):19–24, January 1997; and patent application Ser. No. 08/598,692 filed on Feb. 8, 1996; all of the foregoing references being incorporated herein by reference in their entirety.

In one embodiment, alkylbenzene sulfonate compounds used in accordance with the disclosed compositions and methods and having the characteristics described herein include those having a linear alkyl group. Typically linear alkyl chain lengths are between about 8 and about 16 carbon atoms, although greater and lesser lengths are possible. Typically, low 2-phenyl alkylbenzene sulfonates are employed. In this regard, suitable low 2-phenyl alkylbenzene sulfonate compositions may include mixtures of species having varying molecular weights. Typically, one or more low 2-phenyl alkylbenzene sulfonate compounds, as their sodium salts, having an average molecular weight in the range of from about 292 to about 404, and an average alkyl carbon number of from about 8 to about 16 are employed. Alternatively , one or more low 2-phenyl alkylbenzene sulfonate compounds, as their sodium salts, having an average molecular weight of from about 320 to about 376, and an average alkyl carbon number of from about 10 to about 14 are employed. Alternatively, one or more low 2-phenyl alkylbenzene sulfonate compounds, as their sodium salts, having an average molecular weight of from about 334 to about 362, and an average alkyl carbon number of from about 11 to about 13 are employed.

In other embodiments (such as those employing cations besides sodium), may also include mixtures of species having varying molecular weights. Typically, one or more low 2-phenyl alkylbenzene sulfonate compounds based on low 2-phenyl alkylbenzene sulfonate compounds having an average molecular weight in the range of from about 190 to about 302, and an average alkyl carbon number of from about 8 to about 16 are employed. Alternatively, one or more of such compounds based on low 2-phenyl alkylbenzene compounds having an average molecular weight of from about 218 to about 274, and an average alkyl carbon number of from about 10 to about 14 are employed. Alternatively, one or more of such compounds based on low 2-phenyl alkylbenzene compounds having an average molecular weight of from about 232 to about 260, and an average alkyl carbon number of from about 11 to about 13 are employed. Further possible embodiments are illustrated in Table 24, which lists molecular weight information for various low 2-phenyl alkylbenzene compounds having varying alkyl carbon chain lengths. Information is also provided for acid/sulfate and sodium/sulfate derivatives of these low 2-phenyl alkylbenzene compounds which are useful alone and in various combinations in the practice of the disclosed compounds and method.

Alkyl benzene sulfonates suitable for use in the disclosed method and compositions include any alkyl benzene sulfonates known in the art to be effective or suitable for detergent formulations including, but not limited to, those alkyl benzene sulfonates having a 2-phenyl isomer content of less than about 30% by weight of the molecule, alternatively less than about 29% by weight of the molecule, alternatively less than about 28% by weight of the molecule, alternatively less than about 27% by weight of the molecule, alternatively less than about 26% by weight of the molecule, alternatively less than about 25% by weight of the molecule, alternatively less than about 24% by weight of the molecule, alternatively less than about 23% by weight of the molecule, alternatively less than about 22% by weight of the molecule, alternatively less than about 21% by weight of the molecule, alternatively less than about 20% by weight of the molecule, and alternatively less than about 19% by weight of the molecule. However, with benefit of this disclosure it will be understood that alkyl benzene sulfonates having a 2-phenyl isomer content of 30% by weight of the molecule or greater may also be employed.

Also suitable are alkyl benzene sulfonates having a 2-phenyl isomer content of from about 10% to less than about 25% by weight of the molecule, alternatively from about 10% to about 24% by weight of the molecule, alternatively from about 10% to about 23% by weight of the molecule, alternatively from about 10% to about 22% by weight of the molecule, alternatively from about 10% to about 21% by weight of the molecule, alternatively from about 10% to about 20% by weight of the molecule, and alternatively from about 10% to about 19% by weight of the molecule.

Also suitable are alkyl benzene sulfonates having a 2-phenyl isomer content of from about 12% to less than about 25% by weight of the molecule, alternatively from about 12% to about 24% by weight of the molecule, alternatively from about 12% to about 23% by weight of the molecule, alternatively from about 12% to about 22% by weight of the molecule, alternatively from about 12% to about 21% by weight of the molecule, alternatively from about 12% to about 20% by weight of the molecule, and alternatively from about 12% to about 19% by weight of the molecule.

Also suitable are alkyl benzene sulfonates having a 2-phenyl isomer content of from about 14% to less than about 25% by weight of the molecule, alternatively from about 14% to about 24% by weight of the molecule, alternatively from about 14% to about 23% by weight of the molecule, alternatively from about 14% to about 22% by weight of the molecule, alternatively from about 14% to about 21% by weight of the molecule, and alternatively from about 14% to about 20% by weight of the molecule, and alternatively from about 14% to about 19% by weight of the molecule.

Also suitable are alkyl benzene sulfonates having a 2-phenyl isomer content of from about 15% to less than about 25% by weight of the molecule, alternatively from about 15% to about 24% by weight of the molecule, alternatively from about 15% to about 23% by weight of the molecule, alternatively from about 15% to about 22% by weight of the molecule, alternatively from about 15% to about 21% by weight of the molecule, and alternatively from about 15% to about 20% by weight of the molecule, and alternatively from about 15% to about 19% by weight of the molecule.

As used herein, the term "low 2-phenyl alkyl benzene sulfonate" includes those alkyl benzene sulfonates having a 2-phenyl isomer content of from about 14% to about 20% by weight. Typically the phenyl isomer distribution is substantially uniform across the alkane. As used herein, "high 2-phenyl alkylbenzene sulfonate" characterizes alkylbenzene sulfonates having a phenyl isomer content of from greater than 25% to about 30% 2-phenyl isomer by weight. Typically, the phenyl isomer distribution is predominately in the 2 and 3 position of the alkane. It will be understood by those of skill in the art with benefit of this disclosure that mixtures of low-2-phenyl and high 2-phenyl alkylbenzene sulfonates are also possible, thus yielding 2-phenyl isomer content values between those defined above for the low 2-phenyl and high 2-phenyl alkylbenzene sulfonates.

One specific low 2-phenyl alkylbenzene sulfonate composition is a sulfonate prepared from a linear alkyl benzene known as ALKYLATE 225™ (commercially available from Huntsman Specialty Chemicals Corporation). Other examples of suitable linear alkyl benzenes for preparing linear alkyl benzene sulfonates include, but are not limited to, ALKYLATE 215™, ALKYLATE 229™, ALKYLATE H230L™, and ALKYLATE H230H™ (also available from Huntsman Specialty Chemicals Corporation). Suitable processes for sulfonating such linear alkyl benzenes include, but are not limited to, those employing an air/$SO_3$ sulfonator or chlorosulfonic acid.

In the practice of the disclosed method and compositions, a low 2-phenyl linear alkylbenzene sulfonate may include any counterion or cation suitable for neutralization. In one embodiment a counterion or cation is typically ammonium or substituted ammonium. In this regard, a substituted ammonium may include, but is not limited to, monoethanol ammonium, diethanol ammonium, triethanol ammonium, or a mixture thereof. In another embodiment, such a counterion or cation may be an alkali metal, an alkaline earth metal, or a mixture thereof. Typical alkali metals include, but are not limited to, lithium, sodium, potassium, cesium, or a mixture thereof. Typical alkaline earth metals include, but are not limited to, magnesium, calcium, strontium, barium, or a mixture thereof.

The disclosed surfactant compositions may be provided in solid form without a solvent, or in liquid form with a solvent. In those embodiments employing solvents, any solvent suitable for use in the formulation of a liquid detergent formulation may be employed. Suitable solvents include, for example, those solvents capable of dissolving low 2-phenyl linear alkylbenzene sulfonates. Examples of suitable solvents include, but are not limited to, water, alcohols, glycols and glycol ethers, or mixtures thereof. Specific examples of suitable alcohol solvents include, but are not limited to, alcohols having from about 1 to about 6 carbon atoms. In the practice of the disclosed method and compositions, typical specific solvents include water, straight chain alkyl alcohols containing from one to six carbon atoms (example: methanol, ethanol, n-propanol, n-hexanol, etc.), branched chain alkyl alcohols containing from three to six carbon atoms (example: isopropanol and secondary butanol), glycols such as propylene glycol, diglycols such as propylene diglycol and triglycols such as triethylene glycol and glycol ethers such as butylene glycol diethylether and dipropylene glycol methylether.

Surprisingly it has been found that ethylene oxide/propylene oxide block copolymers having an ethylene oxide content of greater than 15% are effective to enhance the solubility of low 2-phenyl linear alkylbenzene sulfonate surfactants in aqueous solution, while ethylene oxide/propylene oxide block copolymers having an ethylene oxide content of less than or equal to 15% by weight of the polymer molecule do not act to enhance the solubility of low 2-phenyl linear alkylbenzene sulfonate surfactants in aqueous solution. Evidence of this surprising and unexpected behavior may be found demonstrated by the results given in the Examples, particularly the results of Example 2 and Comparative Example B. With benefit of this disclosure, those of skill in the art will understand that the procedures of the examples provide one way of measuring the effectiveness of particular ethylene oxide/propylene oxide block copolymers (e.g., those having varying ethylene oxide content) at enhancing the solubility of low 2-phenyl linear alkylbenzene sulfonates in aqueous solutions and detergent formulations. Table 23 gives examples of particular ethylene oxide/propylene oxide copolymers found to be suitable and unsuitable for enhancing solubility of low 2-phenyl linear alkylbenzene sulfonate surfactants.

Accordingly, in the formulation and practice of the disclosed compositions and methods, typical examples of ethylene oxide/propylene oxide block co-polymer compounds effective to enhance solubility of low 2-phenyl linear alkylbenzene sulfonate surfactants in aqueous solution include, but are not limited to, ethylene oxide/propylene oxide block copolymers having an ethylene oxide content of greater than 15% by weight of the molecule, alternatively equal to or greater than about 16% by weight of the molecule, alternatively equal to or greater than about 17% by weight of the molecule, alternatively equal to or greater than about 18% by weight of the molecule, alternatively equal to or greater than about 19% by weight of the molecule and alternatively equal to or greater than about 20% by weight of the molecule. These co-polymers typically have respective propylene oxide contents of less than 85% by weight of the molecule, alternatively less than or equal to about 84% by weight of the molecule, alternatively less than or equal to about 83% by weight of the molecule, alternatively less than or equal to about 82% by weight of the molecule, alternatively less than or equal to about 81% by weight of the molecule, and alternatively less than or equal to about 80% by weight of the molecule.

More typically, examples of ethylene oxide/propylene oxide block co-polymer compounds effective for enhancing solubility of low 2-phenyl alkylbenzene surfactants in solution include ethylene oxide/propylene oxide block copolymers having an ethylene oxide content from greater than 15% to about 80% by weight of the molecule, alternatively from about 16% to about 80% by weight of the molecule, alternatively from about 17% to about 80% by weight of the molecule, alternatively from about 18% to about 80% by weight of the molecule, alternatively from about 19% to about 80% by weight of the molecule, and alternatively from about 20% to about 80% by weight of the molecule. In each case the balance of the weight of the molecule typically comprises propylene oxide isomer content.

Alternatively, examples of ethylene oxide/propylene oxide block co-polymer compounds effective for enhancing solubility of low 2-phenyl alkylbenzene surfactants in solution include ethylene oxide/propylene oxide block copolymers having an ethylene oxide content from greater than 15% to about 70% by weight of the molecule, alternatively from about 16% to about 70% by weight of the molecule, alternatively from about 17% to about 70% by weight of the molecule, alternatively from about 18% to about 70% by weight of the molecule, alternatively from about 19% to about 70% by weight of the molecule, and alternatively from about 20% to about 70% by weight of the molecule. In each case the balance of the weight of the molecule typically comprises propylene oxide isomer content.

Alternatively, examples of ethylene oxide/propylene oxide block co-polymer compounds effective for enhancing solubility of low 2-phenyl alkylbenzene surfactants in solution include ethylene oxide/propylene oxide block copolymers having an ethylene oxide content from greater than 15% to about 50% by weight of the molecule, alternatively from about 16% to about 50% by weight of the molecule, alternatively from about 17% to about 50% by weight of the molecule, alternatively from about 18% to about 50% by weight of the molecule, alternatively from about 19% to about 50% by weight of the molecule, and alternatively from about 20% to about 50% by weight of the molecule. In each case the balance of the weight of the molecule typically comprises propylene oxide isomer content.

Alternatively, examples of ethylene oxide/propylene oxide block co-polymer compounds effective for enhancing solubility of low 2-phenyl alkylbenzene surfactants in solution include ethylene oxide/propylene oxide block copolymers having an ethylene oxide content from greater than 15% to less than 30% by weight of the molecule, alternatively from about 16% to less than 30% by weight of the molecule, alternatively from about 17% to less than 30% by weight of the molecule, alternatively from about 18% to less than 30% by weight of the molecule, alternatively from about 19% to less than 30% by weight of the molecule, and alternatively from about 20% to less than 30% by weight of the molecule. In each case the balance of the weight of the molecule typically comprises propylene oxide isomer content.

Alternatively, examples of ethylene oxide/propylene oxide block co-polymer compounds effective for enhancing solubility of low 2-phenyl alkylbenzene surfactants in solution include ethylene oxide/propylene oxide block copolymers having an ethylene oxide content from greater than 50% to about 80% by weight of the molecule, alternatively from greater than 50% to about 70% by weight of the molecule, alternatively from greater than 50% to about 60% by weight of the molecule, alternatively from greater than 55% to about 80% by weight of the molecule, alternatively from greater than 55% to about 70% by weight of the molecule, and alternatively from greater than 55% to about 60% by weight of the molecule. In each case the balance of the weight of the molecule typically comprises propylene oxide isomer content.

In combination with any of the above recited amounts of ethylene oxide, an ethylene oxide/propylene oxide may include a propylene oxide hydrophobe that has any effective molecular weight for solubility enhancement according to the methods described herein. Typically, propylene oxide hydrophobe molecular weight is from about 900 to about 3600, although molecular weights greater than 3600, greater than 4000, and less than 950 or less than 900 are possible as well.

In accordance with the above, suitable ethylene oxide/propylene oxide block copolymer solubility enhancers may typically be represented by the formula:

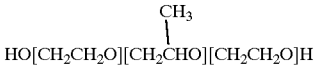

or, alternatively:

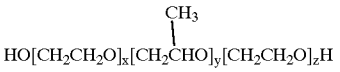

where:

x=number of ethylene oxide blocks z=number of ethylene oxide blocks y=number of propylene oxide blocks.

In one embodiment, for example, for ethylene oxide weight percentages of between about 20% and about 70%, x is typically between about 3.5 and about 150, y is typically between about 21 and about 70, and z is typically between about 3.5 and about 150.

Specific examples of suitable ethylene oxide/propylene oxide block copolymer solubility enhancers include, but are not limited to, ethylene oxide/propylene oxide block copolymer products marketed by Huntsman Chemical Corporation under the trade name SURFONIC™ (such as, for example, SURFONIC POA L-35™, SURFONIC POA L-42™, SURFONIC POA L-44™, and SURFONIC POA L-62™). Table 1 lists percentage ethylene oxide and propylene oxide, as well as values of x, y and z in the above-given formula, for these SURFONIC compounds.

TABLE 1

Huntsman SURFONIC ™ Copolymer Characteristics

| | POA L-35 ™ | POA L-42 ™ | POA L-44 ™ | POA L-62 ™ |
|---|---|---|---|---|
| X | 11 | 3.5 | 9 | 5 |
| Y | 16 | 21 | 21 | 30 |
| Z | 11 | 3.5 | 9 | 5 |
| % EO | 50 | 20 | 40 | 20 |
| % PO | 50 | 80 | 60 | 80 |

Other specific examples of suitable ethylene oxide/propylene oxide block copolymer solubility enhancers include, but are not limited to, ethylene oxide/propylene oxide block copolymer products marketed by BASF under the trade name PLURONIC™ (such as, for example, PLURONIC L122™, PLURONIC L92™, PLURONIC L72™, PLURONIC L62™, PLURONIC L42™, PLURONIC P123™, PLURONIC P103™, PLURONIC L63™, PLURONIC L43™, PLURONIC P104™, PLURONIC P94™, PLURONIC P84™, PLURONIC L64™, PLURONIC L44™, PLURONIC P105™, PLURONIC P85™, PLURONIC P75™, PLURONIC P65™, PLURONIC L35™, PLURONIC F127™, PLURONIC F87™, PLURONIC F77™, PLURONIC F108™, PLURONIC F98™, PLURONIC F88™, PLURONIC F68™, PLURONIC F38™.

In the case of the SURFONIC™ and PLURONIC™ lines of copolymers, each compound is identified by an alphabetical designation followed by a numerical designation. The alphabetical designations L, P and F indicate the physical form of the product (Liquid, Paste or Flaked). The last integer or integer and fractional digit in the numerical designation of an individual compound indicates approximate weight % poly(oxyethylene)hydrophile in the total molecule multiplied by 0.1. The digit or digits preceding the last integer or integer and fractional digit (or the first digit/s following the alphabetical designation) indicate approximate molecular weight of the poly(oxypropylene) hydrophobe divided by 300.

The disclosed surfactant compositions including a solvent typically have reduced cloud and clear points relative to similar conventional surfactant/solvent compositions (i.e., with similar components, but without the disclosed ethylene oxide/propylene oxide solubility enhancing materials). With benefit of this disclosure, it will be understood by those of skill in the art that detergent compositions having any suitable amount of alkylbenzene sulfonate known in the art may benefit from the ethylene oxide/propylene oxide copolymer solubility enhancers of the present disclosure, and it will further be understood that any amount or mixture of ethylene oxide/propylene oxide copolymers effective for enhancing solubility of such alkylbenzene sulfonates in detergent compositions, and/or effective for lowering the cloud or clear point of such compositions, may be employed. Typically, sodium LAS embodiments of the disclosed surfactant compositions have reduced cloud and clear points of about 15° C. to about 35° C., alternatively from about 20° C. to about 30° C., relative to a similar conventional sodium LAS only compositions. In various embodiments, the disclosed sodium LAS-containing surfactant solutions may have cloud points equal to or less than about 25° C., about 20° C., about 15° C., about 10° C., about 5° C., about 0° C. and about −5° C., respectively. In various other embodiments, the disclosed sodium LAS-containing surfactant solutions may have clear points of less than or equal to about 30° C., about 25° C., about 20° C., about 15° C., about 10° C., and about 5° C., respectively.

For example, in the practice of one embodiment of the disclosed method and compositions, a surfactant or detergent composition typically includes between about 2% and about 40% by weight of sodium low 2-phenyl linear alkylbenzene sulfonate surfactant, between about 0.2% and about 10% by weight of ethylene oxide/propylene oxide solubility enhancer, and between about 97.8% and about 50% by weight of water and/or alternatively other solvents (such as alcohol, glycol, glycol ether, etc.). In another embodiment, a surfactant composition may include between about 5% and about 30% by weight of sodium low 2-phenyl linear alkylbenzene sulfonate surfactant, between about 0.8% and about 7% by weight of ethylene oxide/propylene oxide solubility enhancer, and between about 94.2% and about 63% by weight of water and/or alternatively other solvents (such as alcohol, glycol, glycol ether, etc.). In still another surfactant composition embodiment, a surfactant composition includes between about 15% and about 30% by weight of sodium low 2-phenyl linear alkylbenzene sulfonate surfactant, between about 1% and about 5% by weight of ethylene oxide/propylene oxide solubility enhancer, and between about 84% and about 65% by weight of water and/or alternatively other solvents (such as alcohol, glycol, glycol ether, etc.). With benefit of this disclosure, it will be understood by those of skill in the art that a surfactant composition may take the form of a liquid or alternatively a paste or solid form, depending on the molecular weight of the LAS and ethylene oxide/propylene oxide copolymer components, and/or if the amount of solvent is greatly reduced or eliminated.

In other typical embodiments, a low 2-phenyl linear alkylbenzene-based sulfonate surfactant composition may also contain optional additives including, but not limited to, cationic co-surfactant, anionic co-surfactant, nonionic co-surfactant, detergency builder enzyme, enzyme oxidation scavenger, soil suspending agent, soil-release polymer, bactericide, coloring agent, foam control agent, corrosion inhibitor, perfume, or a mixture thereof. Examples of such suitable additives include, but are not limited to, those additives described in pending PCT Application No. PCT/US97/06473 (International Publication No. WO97/39089), which is incorporated herein by reference.

The following examples are illustrative and should not be construed as limiting the scope of the invention or claims thereof.

EXAMPLES

Example 1

LAS Solutions with No Sodium Sulfate Salt Added ("No Salt")

The following example uses an aqueous solution of 21.4% by weight sodium LAS. Cloud point and clear points of the sodium LAS solutions were evaluated with the addition of solubilization enhancement materials in increments by weight. In all experiments ALKYLATE 225™ based LAS-acid was used. This LAS-acid was neutralized with sodium hydroxide, as described in the SLAS preparation section below, to a pH of ≧8. However, sodium hydroxide was not added to the point where it "salted out" the SLAS (the point at which SLAS separates from solution as a solid phase).

LAS Test Solution Preparation

In the following examples, test sodium LAS materials were prepared having the following composition:

LAS-Acid=5.000 gm (20%)

Sodium Hydroxide=0.653 gm (2.61%)

Water=19.353 gm. (77.39%).

This composition, when expressed in terms of the neutralized LAS materials is as follows:

Sodium LAS=5.324 gm (21.4%)

Water=19.665 gm (78.6%).

The percent compositions that are attained, as the increments of additive are added, are shown in Tables 2–10. They are shown as percent based on LAS-acid.

Cloud/Clear Point Evaluation Procedure

For use in the experiments with sodium LAS solutions, a special cloud point/clear point determination apparatus was fabricated. It consisted of a jacketed cell which contained isopropanol. Isopropanol was also passed from a cooler through the outside of the cell jacket. Temperatures of below −20° C. could be attained for this circulating isopropanol. Temperatures well below −10° C. could be achieved for test sample immersed in the isopropanol contained in the cell. A test tube which contained the sample to be evaluated and a thermometer was immersed in the cell isopropanol and evaluated for cloud development under conditions of continuous mixing by means of the thermometer. The temperature at which a persistant cloud developed was identified as the cloud point.

Clear points were determined by letting the test sample, in the test tube, warm slowly, after complete clouding, under ambient conditions, until a state of complete isotropic appearance was attained. The sample, while warming, was stirred intermittently by means of the thermometer that remained in the test tube. The temperature at which the test sample became isotropic was recorded as the clear point.

Cloud/Clear Point Results

The value of ([Additive]/([Additive]+[SLAS]))×100 is given in Table 11 as a measurement of additive efficacy ("EF"). This represents the percent of the total SLAS plus additive used that is additive. This value, for each additive, as the cloud point reaches 0° C. or below for the first time may be used as an indicator of additive efficacy. The lower this number is, the more efficacious the additive. The value of the above equation is represented herein by "EF".

In this example, cloud point/clear point determinations were made for a solution containing a low 2-phenyl linear alkylbenzene sulfonate surfactant ("LAS") in the presence of varying amounts of the disclosed ethylene oxide/propylene oxide block co-polymer solubility enhancers having ethylene oxide contents of greater than about 20% by weight of the molecule. Initially, each solution contained 5.0 g low 2-phenyl linear alkylbenzene sulfonate compound ("225A" available from Huntsman Chemical Corporation), 0.653 g sodium hydroxide, and 19.353 g water. Incremental amounts of ethylene oxide/propylene oxide block co-polymer enhancing agent were added by titration to each solution, and cloud points and clear points were then determined.

Tables 2–5 contain detailed information regarding cloud points and clear points of low 2-phenyl linear alkylbenzene sulfonate solutions to which one of the disclosed ethylene oxide/propylene oxide block co-polymer solubility enhancers has been added (SURFONIC POA L-35™, SURFONIC POA L-42™, SURFONIC POA L-44™, and SURFONIC POA L-62™, available from Huntsman Chemical Corporation). As may be seen from the data in Tables 2–5, both cloud and clear points were lowered substantially by addition of each of the tested ethylene oxide/propylene oxide block co-polymer solubility enhancers.

"SURFONIC POA" materials are ethylene oxide/propylene oxide block copolymers available from Huntsman Corporation. Similar materials are also available from BASF.

TABLE 2

| | Addition of POA L-42 ™ | | | | | | | | | |
|---|---|---|---|---|---|---|---|---|---|---|
| Solution # | 1 | 2 | 3 | 4 | 5 | 6 | 7 | 8 | 9 | 10 |
| % LAS-acid (by wt.) | 20.00 | 19.60 | 19.23 | 18.86 | 18.51 | 17.85 | 17.24 | 16.66 | 16.13 | 15.62 |
| % $H_2O$ | 77.39 | 75.88 | 74.42 | 73.01 | 71.66 | 69.10 | 66.72 | 64.50 | 62.42 | 60.47 |

TABLE 2-continued

| | Addition of POA L-42 ™ | | | | | | | | | |
|---|---|---|---|---|---|---|---|---|---|---|
| Solution # | 1 | 2 | 3 | 4 | 5 | 6 | 7 | 8 | 9 | 10 |
| % NaOH (1:1) | 2.61 | 2.56 | 2.51 | 2.46 | 2.42 | 2.33 | 2.25 | 2.18 | 2.11 | 2.04 |
| % POA L-42 | 0 | 1.96 | 3.85 | 5.66 | 7.41 | 10.71 | 13.79 | 16.66 | 19.35 | 21.87 |
| Cloud Point (° C.) | 20 | 15 | 15 | −2 | −5 | −3 | −5 | −3 | −6 | −5 |
| Clear Point (° C.) | 15 | 14 | 13 | 3 | 2 | 4 | 3 | 4 | 3 | 1 |

TABLE 3

| | Addition of POA L-62 ™ | | | | | | | |
|---|---|---|---|---|---|---|---|---|
| Solution # | 1 | 2 | 3 | 4 | 5 | 6 | 7 | 8 |
| % LAS-acid (by wt.) | 20.00 | 19.60 | 19.23 | 18.86 | 18.51 | 17.85 | 17.24 | 16.66 |
| % $H_2O$ | 77.39 | 75.88 | 74.42 | 73.01 | 71.66 | 69.10 | 66.72 | 64.50 |
| % NaOH (1:1) | 2.61 | 2.56 | 2.51 | 2.46 | 2.42 | 2.33 | 2.25 | 2.18 |
| % POA L-62 | 0 | 1.96 | 3.85 | 5.66 | 7.41 | 10.71 | 13.79 | 16.66 |
| Cloud Point (° C.) | 20 | 19 | 17 | 15 | −5 | −4 | −2 | <−7 |
| Clear Point (° C.) | 18 | 15 | 14 | 13 | 3 | 4 | 3 | n/d |

TABLE 4

| | Addition of POA L-44 ™ | | | | | | | | | |
|---|---|---|---|---|---|---|---|---|---|---|
| Solution # | 1 | 2 | 3 | 4 | 5 | 6 | 7 | 8 | 9 | 10 |
| % LAS-acid (by wt.) | 20.00 | 19.60 | 19.23 | 18.86 | 18.51 | 17.85 | 17.24 | 16.66 | 16.13 | 15.62 |
| % $H_2O$ | 77.39 | 75.88 | 74.42 | 73.01 | 71.66 | 69.10 | 66.72 | 64.50 | 62.42 | 60.47 |
| % NaOH (1:1) | 2.61 | 2.56 | 2.51 | 2.46 | 2.42 | 2.33 | 2.25 | 2.18 | 2.11 | 2.04 |
| % POA L-44 | 0 | 1.96 | 3.85 | 5.66 | 7.41 | 10.71 | 13.79 | 16.66 | 19.35 | 21.87 |
| Cloud Point (° C.) | 18 | 12 | 1 | −7 | −5 | −3 | −4 | −8 | −9 | −7 |
| Clear Point (° C.) | 15 | 13 | 6 | −1 | 3 | 2 | 2 | 3 | 3 | 4 |

TABLE 5

| | Addition of POA L-35 ™ | | | | | | | | | |
|---|---|---|---|---|---|---|---|---|---|---|
| Solution # | 1 | 2 | 3 | 4 | 5 | 6 | 7 | 8 | 9 | 10 |
| % LAS-acid (by wt.) | 20.00 | 19.60 | 19.23 | 18.86 | 18.51 | 17.85 | 17.24 | 16.66 | 16.13 | 15.62 |
| % $H_2O$ | 77.39 | 75.88 | 74.42 | 73.01 | 71.66 | 69.10 | 66.72 | 64.50 | 62.42 | 60.47 |
| % NaOH (1:1) | 2.61 | 2.56 | 2.51 | 2.46 | 2.42 | 2.33 | 2.25 | 2.18 | 2.11 | 2.04 |
| % POA L-35 | 0 | 1.96 | 3.85 | 5.66 | 7.41 | 10.71 | 13.79 | 16.66 | 19.35 | 21.87 |
| Cloud Point (° C.) | 19 | 11 | 3 | −4 | −7 | −6 | −6 | −7 | −5 | −9 |
| Clear Point (° C.) | 10 | 13 | 7 | 5 | 4 | 4 | 3.5 | 3 | 3 | 3 |

Comparative Example A

Various Additives Tested with LAS Solutions Having No Sodium Sulfate Salt Added ("No Salt")

In this example, cloud point/clear point determinations were made for the same solution containing low 2-phenyl linear alkylbenzene sulfonate surfactant of Example 1. Incremental amounts of conventional solubility enhancing agents were added by titration to each solution and cloud points and clear points were then determined.

Tables 6–10 contain detailed information regarding clear points and cloud points of the low 2-phenyl linear alkylbenzene sulfonate solution to which the conventional solubility enhancing agents have been added ("SXS", "MDEA", "DMEA", "DOWFAX 3B2", or "DOWVFAX HYDRO").

SXS is sodium xylene sulfonate commonly employed as hydrotrope and solubilization agent. MDEA is methydiethanol amine and DMEA is dimethylethanol amine. Both of these amines are employed as solubilization agents for other surfactant systems. SXS, MDEA and DMEA are commercially available from Huntsman Specialty Chemicals Corporation. The Dowfax materials are mixtures of sulfonated alkyldiphenyl ethers commercially available from Dow Chemical Co. These are commonly well known hydrotropes and solubilization agents.

It is to be noted that, by this method, the lowest cloud points attained by SXS, DMEA or MDEA did not go below 0° C.

TABLE 6

| Addition of "SXS" ™ | | | | | | | | | | | | |
|---|---|---|---|---|---|---|---|---|---|---|---|---|
| Solution # | 1 | 2 | 3 | 4 | 5 | 6 | 7 | 8 | 9 | 10 | 11 | 12 |
| % LAS-acid (by wt.) | 20.00 | 18.18 | 16.66 | 15.38 | 14.28 | 13.33 | 12.88 | 12.50 | 12.10 | 11.74 | 11.41 | 11.11 |
| % $H_2O$ | 77.39 | 75.81 | 74.50 | 73.38 | 72.42 | 71.60 | 71.21 | 70.87 | 70.53 | 70.21 | 69.93 | 69.66 |
| % NaOH (1:1) | 2.61 | 2.37 | 2.18 | 2.01 | 1.87 | 1.74 | 1.68 | 1.63 | 1.58 | 1.53 | 1.49 | 1.45 |
| % "SXS" | 0 | 3.64 | 6.67 | 9.23 | 11.43 | 13.33 | 14.22 | 15.00 | 15.78 | 16.52 | 17.17 | 17.78 |
| Cloud Point (° C.) | 10 | 22 | 21 | 14 | 6 | 4 | 3 | 3 | 2 | 2 | 2 | 2 |
| Clear Point (° C.) | 14 | 23 | 21 | 15 | 8 | 5 | 4 | 4 | 3 | 3 | 3 | 3 |

TABLE 7

| Addition of "MDEA" | | | | | | | | |
|---|---|---|---|---|---|---|---|---|
| Solution # | 1 | 2 | 3 | 4 | 5 | 6 | 7 | 8 |
| % LAS-acid (by wt.) | 20.00 | 19.23 | 18.51 | 17.85 | 17.24 | 16.66 | 16.39 | 16.13 |
| % $H_2O$ | 77.39 | 74.42 | 71.66 | 69.10 | 66.72 | 64.50 | 63.44 | 62.42 |
| % NaOH (1:1) | 2.61 | 2.51 | 2.42 | 2.33 | 2.25 | 2.18 | 2.14 | 2.11 |
| % "MDEA" | 0 | 3.85 | 7.41 | 10.71 | 13.79 | 16.66 | 18.03 | 19.35 |
| Cloud Point (° C.) | 19 | 17 | 10 | 9 | 6 | 5 | 6 | 6 |
| Clear Point (° C.) | 15 | 13 | 9 | 6.5 | 5.5 | 6 | 5.5 | 5.5 |

TABLE 8

| Addition of "DMEA" | | | | | | | | | | | | |
|---|---|---|---|---|---|---|---|---|---|---|---|---|
| Solution # | 1 | 2 | 3 | 4 | 5 | 6 | 7 | 8 | 9 | 10 | 11 | 12 |
| % LAS-acid (by wt.) | 20.00 | 19.23 | 18.51 | 17.85 | 17.24 | 16.66 | 16.39 | 16.13 | 15.87 | 15.62 | 15.38 | 13.89 |
| % $H_2O$ | 77.39 | 74.42 | 71.66 | 69.10 | 66.72 | 64.50 | 63.44 | 62.42 | 61.43 | 60.47 | 59.54 | 53.75 |
| % NaOH (1:1) | 2.61 | 2.51 | 2.42 | 2.33 | 2.25 | 2.18 | 2.14 | 2.11 | 2.07 | 2.04 | 2.01 | 1.81 |
| % "DMEA" | 0 | 3.85 | 7.41 | 10.71 | 13.79 | 16.66 | 18.03 | 19.35 | 20.63 | 21.87 | 23.07 | 30.55 |
| Cloud Point (° C.) | — | 9 | 8 | 6 | 8 | 7 | 7 | 7 | 7 | 7 | — | 6 |
| Clear Point (° C.) | — | 11 | 9 | 7 | 8 | 8 | 7 | 7 | 7 | 7 | — | 7 |

TABLE 9

| Addition of "DOWFAX 3B2" | | | | | | |
|---|---|---|---|---|---|---|
| Solution # | 1 | 2 | 3 | 4 | 5 | 6 |
| % LAS-acid (by wt.) | 20.00 | 18.31 | 17.00 | 15.77 | 14.75 | |
| % $H_2O$ | 77.39 | 75.51 | 74.04 | 72.66 | 71.52 | 70.51 |
| % NaOH (1:1) | 2.61 | 2.39 | 2.22 | 2.06 | 1.93 | 1.01 |
| % "Dowfax 3B2" | 0 | 3.79 | 6.73 | 9.51 | 11.81 | 13.83 |
| Cloud Point (° C.) | 18 | 5 | 1 | −2 | −3 | −4 |
| Clear Point (° C.) | 14 | 7 | 5 | 3 | 4 | 3 |

TABLE 10

| Addition of "DOWFAX HYDRO" | | | | | | | | |
|---|---|---|---|---|---|---|---|---|
| Solution # | 1 | 2 | 3 | 4 | 5 | 6 | 7 | 8 |
| % LAS-acid (by wt.) | 20.00 | 18.45 | 17.12 | 15.97 | 14.97 | 14.08 | 13.66 | 13.30 |
| % $H_2O$ | 77.39 | 75.43 | 73.74 | 72.28 | 71.01 | 69.88 | 69.35 | 68.89 |
| % NaOH (1:1) | 2.61 | 2.41 | 2.24 | 2.09 | 1.95 | 1.84 | 1.78 | 1.74 |
| % "Dowfax Hydro" | 0 | 3.72 | 6.90 | 9.66 | 12.07 | 14.19 | 15.21 | 16.08 |

TABLE 10-continued

| Addition of "DOWFAX HYDRO" | | | | | | | | |
|---|---|---|---|---|---|---|---|---|
| Solution # | 1 | 2 | 3 | 4 | 5 | 6 | 7 | 8 |
| Cloud Point (° C.) | 20 | 11 | 8 | 3 | −2 | −6 | −6 | −6 |
| Clear Point (° C.) | 15 | 15 | 10 | 9 | 7 | 4 | 4 | 3 |

Table 11 contains a summary of the experimental results of Example 1 (Tables 2–5) and Comparative Example A (Tables 6–10). Table 11 shows the first cloud point attained below 0° C. (if any), the lowest cloud point attained, and the clear point corresponding to the 0° C. cloud point concentration or, alternatively (in the cases where the cloud point remained above 0° C.), the lowest clear point attained for each additive tested. Table 11 additionally presents the amount of each additive tested both as a percentage by weight of the entire solution, and as a percentage by weight of the amount of low 2-phenyl alkylbenzene sulfonate plus additive present in solution. As can be seen from these results, three of the four ethylene oxide/propylene oxide block co-polymer materials were capable of attaining a lowest cloud point (lower than −6° C.) lower than any of the conventional additives tested. Furthermore, a much greater percentage by weight of each of the conventional additives was required to produce a solution with a cloud point less than 0° C., relative to the ethylene oxide/propylene oxide block co-polymer materials.

Still referring to Table 11, lower values of % additive (expressed as a function of weight of additive and alkylbenzene sulfonate, and also as function of weight of total solution) indicate less of the disclosed ethylene oxide/propylene oxide block co-polymer additives than the tested conventional additives were required to make the ALKYLATE 225™ based low 2-phenyl linear alkylbenzene sulfonate soluble in a water solution. In this regard, lower cloud points and clear points were achieved using lower amounts of ethylene oxide/propylene oxide block co-polymer (SURFONIC POA L-35™, SURFONIC POA L-42™, SURFONIC POA L-44™, and SURFONIC POA L-62™) than were achieved with the conventional additives tested. In the aqueous solution, it may be seen that as little as about 60% of the amount of SURFONIC POA L-35™, SURFONIC POA L-42™, and SURFONIC POA L-44™ are needed to attain cloud points lower than those of the best-performing tested hydrotrope ("DOWFAX 3B2").

The results summarized in Table 11 clearly indicate the superiority of the disclosed ethylene oxide/propylene oxide block co-polymer materials for improving the solubility of a low 2-phenyl linear alkylbenzene sulfonate surfactant in comparison to the performance of several known conventional solubility-enhancing additives.

TABLE 11

Summary of Experiments Detailed in Tables 2–10

| Additive | First Cloud Point Below ° C. | Clear Point, ° C. | 100(x){Additive/(Additive + LAS)} | % Additive by Weight of Solution | Lowest Cloud Point, ° C. |
|---|---|---|---|---|---|
| "SXS" | none | 3 | 50.82 | 14.2 | +2 |
| "Dowfax 3B2" | −2 | 3 | 36.08 | 9.5 | −4 |
| "Dowfax Hydro" | −2 | 7 | 43.01 | 12.1 | −6 |
| "DMEA" | none | 7 | 48.35 | 16.7 | 7 |
| "MDEA" | none | 6 | 48.35 | 16.7 | 5 |
| POA L-35 | −4 | 5 | 21.92 | 5.7 | −9 |
| POA L-42 | −2 | 3 | 21.92 | 5.7 | −6 |
| POA L-44 | −7 | −1 | 21.92 | 5.7 | −9 |
| POA L-62 | −5 | 3 | 27.24 | 7.4 | <−7 |

Example 2

Sodium LAS Solution Using Modified Solubility Titration Method

The following two sets of experiments were carried out by a modified solubility titration method. In these experiments, neutralization of the LAS-Acid was accomplished with sodium hydroxide (final pH of 8.5 to 9.5). The sodium LAS was then "salted out" with a known amount of sodium sulfate before adding the additive.

SLAS Preparation

Neutralization of the LAS-acid was conducted as before but under more controlled conditions. As an example, the following procedure for making an approximate 20% ALKYLATE 222™ LAS solution useful for the evaluation of clear/cloud points was followed. A total of 1440 grams of test solution was made, and 25 gram samples were used for the actual test runs. A final sodium LAS concentration in the 25 gram test sample was calculated to be approximately 23.7%.

The following preparation procedure was employed: 339.2 grams of the ALKYLATE 225™ LAS-acid and an appropriate mechanical stirrer were placed into a clean beaker. Next, 1100.0 grams of cool, deionized water was added, followed by a slow addition of 86.77 grams of a 1:1 NaOH/deionized water solution. The resulting mixture was vigorously stirred by the mechanical mixer, with ice bath cooling as required to maintain near ambient temperature for 45 to 60 minutes. A final solution pH measurement afforded a value of 9.0.

SLAS "Salted Out" Test Solution Preparation

The test solution was prepared by the following procedures.

1) The following materials were placed into the test cell:
   12.933 grams of SLAS (23.7% active)
   12.575 grams of Deionized water
2) The resulting solution was then mixed and shaken until a clear isotropic solution was obtained.
3) The following material was then added to the solution: 0.565 grams of sodium sulfate
4) The solution was then shaken and mixed until all of the sodium sulfate went into solution and the entire solution was uniformly hazy (milky) in appearance. This solution had a cloud point of about 30° C.
5) In each case, about 0.20 grams of the selected additive was added to this solution and the cloud point and clear point determinations made.
6) Increments of about 0.20 grams of the selected additive were then added and the cloud point retaken after each such addition until a total of about 2.6 grams of the selected additive had been added.

Results are given in Tables 12–15.

The following co-polymers were found to be effective at lowering test solution cloud points: SURFONIC POA L-62™, SURFONIC POA L-64™, SURFONIC POA P-105™, and SURFONIC POA F-127™. All had a similar efficacy with EF~25 (cloud points from −1° C. to −5° C.).

By far the most surprising finding of the entire test sequence is that the SURFONIC™ materials with only 10% polyethylene oxide content (SURFONIC POA L-61 ™, SURFONIC POA L-81™ and SURFONIC POA L-101™) did not lower the cloud point of our test SLAS solution. Even more surprising was the finding that these co-polymer materials increased the test solution cloud point. These findings highlight the influence that polyethylene oxide content versus polypropylene oxide content of a copolymer additive have on the ability of the copolymer to lower the cloud point of sodium LAS solutions.

TABLE 12

| | Addition of "POA L-62" | | | | | | | | | | | | |
|---|---|---|---|---|---|---|---|---|---|---|---|---|---|
| Solution # | 0 | 1 | 2 | 3 | 4 | 5 | 6 | 7 | 8 | 9 | 10 | 11 | 12 |
| % Na LAS (by wt.) | 12.02 | 11.92 | 11.82 | 11.73 | 11.63 | 11.54 | 11.45 | 11.36 | 11.27 | 11.19 | 11.10 | 11.02 | 10.94 |
| % $H_2O$ | 87.98 | 87.27 | 86.56 | 85.89 | 85.14 | 84.48 | 83.81 | 83.17 | 82.53 | 81.90 | 81.30 | 80.65 | 80.07 |
| % L-62 | 0 | 0.82 | 1.62 | 2.38 | 3.23 | 3.98 | 4.75 | 5.48 | 6.20 | 6.92 | 7.60 | 8.33 | 8.99 |
| Cloud Point ° C. | 29.6 | 28.5 | 26.3 | 25.1 | 10.5 | −3.3 | −7.8 | −7.9 | −7.5 | −7.4 | −6.8 | −7.0 | −6.4 |
| Clear Point ° C. | 37.7 | 41.3 | 46.9 | 47.0 | 55.4 | 10.5 | 9.9 | 5.9 | 8.1 | 8.0 | 6.7 | 6.5 | 6.7 |

TABLE 13

| | Addition of "POA L-64" | | | | | | | | | | | | |
|---|---|---|---|---|---|---|---|---|---|---|---|---|---|
| Solution # | 0 | 1 | 2 | 3 | 4 | 5 | 6 | 7 | 8 | 9 | 10 | 11 | 12 |
| % Na LAS (by wt.) | 12.02 | 11.92 | 11.83 | 11.74 | 11.65 | 11.56 | 11.47 | 11.38 | 11.29 | 11.21 | 11.12 | 11.03 | 10.95 |
| % $H_2O$ | 87.98 | 87.29 | 86.61 | 85.94 | 85.28 | 84.61 | 83.95 | 83.32 | 82.67 | 82.05 | 81.44 | 80.79 | 80.19 |
| % L-62 | 0 | 0.79 | 1.56 | 2.32 | 3.08 | 3.83 | 4.58 | 5.30 | 6.04 | 6.74 | 7.44 | 8.18 | 8.85 |
| Cloud Point ° C. | 32.6 | 33.2 | 20.9 | 8.3 | 3.7 | −5.3 | −4.3 | −4.9 | −4.3 | −4.6 | −4.6 | −4.4 | −2.1 |
| Clear Point ° C. | 38.7 | 36.7 | 29.8 | 23.1 | 16.7 | 8.1 | 4 | 6.6 | 4.8 | 4.3 | 4.2 | 4.5 | 4.5 |

TABLE 14

| | Addition of "POA P-105" | | | | | | | | | | | | |
|---|---|---|---|---|---|---|---|---|---|---|---|---|---|
| Solution # | 0 | 1 | 2 | 3 | 4 | 5 | 6 | 7 | 8 | 9 | 10 | 11 | 12 |
| % Na LAS (by wt.) | 12.02 | 11.92 | 11.83 | 11.73 | 11.64 | 11.54 | 11.45 | 11.36 | 11.27 | 11.18 | 11.10 | 11.02 | 10.94 |
| % $H_2O$ | 87.98 | 87.25 | 86.58 | 85.86 | 85.20 | 84.50 | 83.86 | 83.18 | 82.50 | 81.88 | 81.27 | 80.69 | 80.09 |
| % L-62 | 0 | 0.83 | 1.59 | 2.41 | 3.16 | 3.96 | 4.69 | 5.46 | 6.23 | 6.94 | 7.63 | 8.29 | 8.97 |
| Cloud Point ° C. | 30.9 | 29.5 | 20.0 | 11.2 | 3.1 | −4.4 | −5.8 | −4.5 | −3.0 | −7.5 | −6.7 | −9.9 | −6.2 |
| Clear Point ° C. | 37.6 | 35.7 | 30.3 | 20.3 | 20.9 | 15.3 | 8.3 | 15.3 | 14.5 | 18.7 | 18.9 | 11.5 | 11.9 |

TABLE 15

| | Addition of "POA P-127" | | | | | | | | | | | | |
|---|---|---|---|---|---|---|---|---|---|---|---|---|---|
| Solution # | 0 | 1 | 2 | 3 | 4 | 5 | 6 | 7 | 8 | 9 | 10 | 11 | 12 |
| % Na LAS (by wt.) | 12.02 | 11.92 | 11.82 | 11.73 | 11.63 | 11.54 | 11.45 | 11.37 | 11.28 | 11.19 | 11.11 | 11.03 | 10.94 |
| % $H_2O$ | 87.98 | 87.25 | 86.56 | 85.86 | 85.19 | 84.53 | 83.88 | 83.23 | 82.59 | 81.96 | 81.35 | 80.74 | 80.14 |
| % L-62 | 0 | 0.83 | 1.62 | 2.41 | 3.18 | 3.93 | 4.67 | 5.40 | 6.13 | 6.84 | 7.54 | 8.23 | 8.92 |
| Cloud Point ° C. | 23.7 | 18.1 | 17.6 | 8.1 | 0.5 | −1.0 | −6.7 | −4.5 | −7.3 | −8.4 | −6.8 | −7.0 | −6.9 |
| Clear Point ° C. | 41.6 | 34.1 | 30.2 | 23.1 | 17.6 | 13.6 | 13.8 | 9.6 | 9.5 | 13.3 | 10.8 | 10.1 | 10.6 |

Comparative Example B

Sodium LAS ("SLAS") Solutions Tested with Low Ethylene Oxide Polyols (Sodium Sulfate Salt Added)

The following experiments were conducted in a similar manner as in Example 2.

In this example, cloud point/clear point determinations were made for a solution containing a low 2-phenyl linear alkylbenzene sulfonate surfactant in the presence of varying amounts of several ethylene oxide/propylene oxide block co-polymer compounds having 15% or less ethylene oxide by weight of the molecule. Surprisingly, the ethylene oxide/propylene oxide block co-polymer compounds tested in this example did not enhance the solubility of low 2-phenyl linear alkylbenzene sulfonate surfactants in aqueous solution. In fact, ethylene oxide/propylene oxide block co-polymer compounds tested in this comparative example decreased solubility of low 2-phenyl linear alkylbenzene sulfonate surfactants in aqueous solution, as indicated by increased cloud points and clear points.

For these experiments, 10% by weight ethylene oxide and 15% by weight ethylene oxide copolymers were evaluated. The 15% by weight ethylene oxide test materials were prepared by blending according to the following ratios. This blending procedure was used to formulate polyols containing about 15% ethylene oxide by weight of the molecule.

L61.5=10 grams L62+10 grams L61

L-81.5=50 grams L-81+10 grams P-84 (A)

L-101.5=70 grams L-101+10 grams P-105 (A)

Results of Comparative Example B are shown in Tables 16–22 and summarized with results of Example 2 in Table 23. These results show that ethylene oxide/propylene oxide copolymers that contain 15% or less ethylene oxide do not serve to enhance the solubility of the linear alkylbenzene sulfonate prepared from ALKYLATE 225™. They do in fact, as do the block copolymers that contain only approximately 10% ethylene oxide, decrease the sodium linear alkylbenzene sulfonate solubility. For example, the lowest cloud point and clear point for SURFONIC POA L-81.5™ and for SURFONIC POA L-101.5™ occur with no copolymer additive. For SURFONIC POA L-61.5™, the lowest cloud point occurs at the first additive increment and then increases with each increment thereafter, while the lowest clear point occurs with no copolymer additive. Significantly, no cloud point below 0° C. was achieved in either case.

This serves to demonstrate the surprising and unexpected nature of the disclosed solubility enhancers and method of solubilization, in which ethylene oxide/propylene oxide block copolymers having an ethylene oxide content of greater than 15% by weight, and a propylene oxide content of less than 85% by weight have a solubility enhancing effect on aqueous solutions of low 2-phenyl linear alkylbenzene sulfonate surfactants, while those having an ethylene oxide content of equal to or less than 15% by weight of the molecule do not.

TABLE 16

| Addition of "POA L-61" | | | | | | | | |
|---|---|---|---|---|---|---|---|---|
| Solution # | 0 | 1 | 2 | 3 | 4 | 5 | 6 | 7 |
| % Na LAS (by wt.) | 12.02 | 11.91 | 11.82 | 11.73 | 11.63 | 11.54 | n/d | n/d |
| % $H_2O$ | 87.98 | 87.24 | 86.54 | 85.86 | 85.18 | 84.52 | n/d | n/d |
| % L-61 | 0 | 0.85 | 1.64 | 2.41 | 3.19 | 3.94 | n/d | n/d |
| Cloud Point ° C. | 26.8 | 36.6 | n/d | 75.7 | 82.9 | 86.7 | n/d | n/d |
| Clear Point ° C. | 35.8 | 56.7 | 74.5 | 79.3 | 85.1 | 91.8 | n/d | n/d |

TABLE 17

| Addition of "POA L-61.5" | | | | | | | | | | | | | |
|---|---|---|---|---|---|---|---|---|---|---|---|---|---|
| Solution # | 0 | 1 | 2 | 3 | 4 | 5 | 6 | 7 | 8 | 9 | 10 | 11 | 12 |
| % Na LAS (by wt.) | 12.02 | 11.92 | 11.82 | 11.73 | 11.64 | 11.55 | 11.46 | 11.36 | 11.27 | 11.19 | 11.10 | 11.01 | 10.93 |
| % $H_2O$ | 87.98 | 87.26 | 86.57 | 85.91 | 85.24 | 84.56 | 83.90 | 83.21 | 82.56 | 81.92 | 81.27 | 80.63 | 80.05 |
| % L-61.5 | 0 | 0.82 | 1.61 | 2.36 | 3.12 | 3.89 | 4.64 | 5.43 | 6.17 | 6.89 | 7.63 | 8.36 | 9.01 |
| Cloud Point ° C. | 29.5 | 21.6 | 51.1 | 50 | 68.5 | 71.1 | 71.6 | 71.6 | 71.6 | 70.6 | 67.8 | 65.5 | 61.9 |
| Clear Point ° C. | 36.5 | 46.4 | 64.5 | 68.0 | 71.5 | 77.9 | 75.7 | 78.9 | 80.6 | 79.9 | 81.7 | 81.9 | 77.9 |

TABLE 18

| Addition of "POA L-101" | | | | | | | | |
|---|---|---|---|---|---|---|---|---|
| Solution # | 0 | 1 | 2 | 3 | 4 | 5 | 6 | 7 |
| % Na LAS (by wt.) | 12.02 | 11.92 | 11.83 | 11.74 | 11.64 | 11.55 | 11.46 | n/d |
| % $H_2O$ | 87.98 | 87.29 | 86.61 | 85.93 | 85.22 | 84.57 | 83.89 | n/d |
| % L-101 | 0 | 0.79 | 1.56 | 2.33 | 3.14 | 3.88 | 4.66 | n/d |
| Cloud Point ° C. | 31.9 | 56.5 | 69.8 | 73.9 | 76.4 | 77.4 | 77.6 | n/d |
| Clear Point ° C. | 39.1 | 68.9 | 76.7 | 78.7 | 81.6 | 81.5 | 78.1 | n/d |

TABLE 19

| Addition of "POA L-101.5" | | | | | | | | | | | | | |
|---|---|---|---|---|---|---|---|---|---|---|---|---|---|
| Solution # | 0 | 1 | 2 | 3 | 4 | 5 | 6 | 7 | 8 | 9 | 10 | 11 | 12 |
| % Na LAS (by wt.) | 12.02 | 11.92 | 11.82 | 11.72 | 11.63 | 11.54 | 11.45 | 11.36 | 11.28 | 11.19 | 11.11 | 11.03 | 10.95 |
| % $H_2O$ | 87.98 | 87.25 | 86.55 | 85.84 | 85.18 | 84.52 | 83.84 | 83.21 | 82.56 | 81.93 | 81.34 | 80.74 | 80.15 |
| % L-101.5 | 0 | 0.83 | 1.63 | 2.44 | 3.19 | 3.94 | 4.71 | 5.43 | 6.16 | 6.88 | 7.55 | 8.23 | 8.90 |
| Cloud Point ° C. | 28.9 | 60.5 | 70.2 | 73.2 | 73.6 | 73.2 | 73.4 | 72.5 | 69.3 | 66.9 | 65.0 | 61.0 | 58.2 |
| Clear Point ° C. | 38.9 | 81.0 | 76.7 | 77.2 | 78.5 | 83.2 | 84.1 | 79.7 | 77.6 | 77.7 | 73.3 | 73.4 | 69.1 |

TABLE 20

| Addition of "POA L-81" | | | | | | | | | |
|---|---|---|---|---|---|---|---|---|---|
| Solution # | 0 | 1 | 2 | 3 | 4 | 5 | 6 | 7 | 8 |
| % Na LAS (by wt.) | 12.02 | 11.92 | 11.82 | 11.72 | 11.63 | 11.54 | 11.45 | 11.36 | n/d |
| % $H_2O$ | 87.98 | 87.26 | 86.52 | 85.83 | 85.16 | 84.49 | 83.82 | 83.18 | n/d |
| % L-81 | 0 | 0.82 | 1.66 | 2.45 | 3.21 | 3.97 | 4.73 | 5.46 | n/d |
| Cloud | 23.3 | 40.8 | 66.4 | 70.9 | 74.8 | 76.2 | 76.7 | 77.4 | n/d |

TABLE 20-continued

| Addition of "POA L-81" | | | | | | | | | |
|---|---|---|---|---|---|---|---|---|---|
| Solution # | 0 | 1 | 2 | 3 | 4 | 5 | 6 | 7 | 8 |
| Point ° C. | | | | | | | | | |
| Clear Point ° C. | 40.1 | 60.3 | 72.2 | 75.3 | 78.9 | 79.2 | 78.9 | 83.0 | n/d |

TABLE 21

| Solution # | 0 | 1 | 2 | 3 | 4 | 5 | 6 | 7 | 8 | 9 | 10 | 11 | 12 |
|---|---|---|---|---|---|---|---|---|---|---|---|---|---|
| | Addition of "POA L-81.5" | | | | | | | | | | | | |
| % Na LAS (by wt.) | 12.02 | 11.92 | 11.82 | 11.72 | 11.63 | 11.54 | 11.45 | 11.37 | 11.28 | 11.19 | 11.11 | 11.02 | 10.94 |
| % $H_2O$ | 87.98 | 87.26 | 86.53 | 85.83 | 85.17 | 84.50 | 83.85 | 83.21 | 82.55 | 81.95 | 81.31 | 80.72 | 80.12 |
| % L-81.5 | 0 | 0.82 | 1.65 | 2.45 | 3.20 | 3.96 | 4.70 | 5.42 | 6.17 | 6.86 | 7.58 | 8.26 | 8.94 |
| Cloud Point ° C. | 29.4 | 40.1 | 50.4 | 67.4 | 71.6 | 71.9 | 71.9 | 72.0 | 71.4 | 68.1 | 64.2 | 61.9 | 59.6 |
| Clear Point ° C. | 37.4 | 54.9 | 67.0 | 71.5 | 75.6 | 76.0 | 76.8 | 79.8 | 76.1 | 73.6 | 72.5 | 72.9 | 68.7 |

TABLE 22

LAS Solutions With Sodium Sulfate Salt and Low Ethylene Oxide Additives SODIUM LAS + WATER + SODIUM SULFATE + ADDITIVE

| Additive | Cloud Point* ° C. | Clear Point* ° C. | 100(x) (Additive/ Additive + SLAS) | % Add-itive | Lowest Cloud Point; ° C. | Lowest Clear Point; ° C. |
|---|---|---|---|---|---|---|
| POA L-61.5 | 21.6 | 36.5 | 6.5 | 0.824 | 21.6 | Occurs With No Additive |
| POA L-81.5A | 29.4 | 37.4 | N/A | N/A | Occurs With No Additive | Occurs With No Additive |
| L-101.5A | 28.9 | 38.9 | N/A | N/A | Occurs With No Additive | Occurs With No Additive |

*This cloud point is the first cloud point closest to ° C. and this clear point is the one corresponding to the stated cloud point.

TABLE 23

Summary of Solubility Enhancement by Ethylene Oxide Content

| Materials Increasing Solubility of SLAS | Ethylene Oxide (% by weight) | Materials Decreasing Solubility of SLAS | % Ethylene Oxide (% by wt.) |
|---|---|---|---|
| POA L-35 | 50 | POA L-61 | 10 |
| POA L-42 | 20 | POA L-81 | 10 |
| POA L-44 | 40 | POA L-101 | 10 |
| POA L-62 | 20 | POA L-61.5 | 15 |
| POA L-64 | 40 | POA L-81.5 | 15 |
| POA P-105 | 50 | POA L-101.5 | 15 |
| POA F-127 | 70 | | |

TABLE 24

Molecular Weights Of Linear Alkyl Benzenes

| R = Alkyl Group | R-phenyl ring LAB | R-phenyl-$SO_3$-acid LAS-acid | R-phenyl-$SO_3Na$ Sodium LAS |
|---|---|---|---|
| R = $C_8$ | 190 | 270 | 292 |
| R = $C_{10}$ | 218 | 298 | 320 |
| R = $C_{11}$ | 232 | 312 | 334 |
| R = $C_{12}$ | 246 | 326 | 348 |
| R = $C_{13}$ | 260 | 340 | 362 |
| R = $C_{14}$ | 274 | 354 | 376 |
| R = $C_{16}$ | 302 | 382 | 404 |

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed compositions and methods may be utilized in various combinations and/or independently. Thus the invention is not limited to only those combinations shown herein, but rather may include other combinations.

What is claimed is:

1. A surfactant composition consisting of:

at least one low 2-phenyl alkylbenzenc sulfonate;

at least one solvent; and at least one ethylene oxide/propylene oxide block co-polymer solubility enhancer;

wherein said ethylene oxide/propylene oxide block co-polymer has a content of ethylene oxide greater than 15% by weight of the molecule; and wherein said surfactant composition is an aqueous solution.

2. The surfactant composition of claim 1, wherein said ethylene oxide/propylene oxide block copolymer has the formula:

$$HO[CH_2CH_2O]_x[CH_2\overset{\overset{\displaystyle CH_3}{|}}{C}HO]_y[CH_2CH_2O]_zH; \text{ and}$$

wherein x is between about 3.5 and about 150, y is between about 16 and about 70, and z is between about 3.5 and about 150.

3. The surfactant composition of claim 2, wherein said low 2-phenyl alkylbenzene sulfonate is a low 2-phenyl linear alkylbenzene sulfonate.

4. The surfactant composition of claim 2, wherein said low 2-phenyl alkylbenzene sulfonate is a linear alkylbenzene sulfonate having a 2-phenyl isomer content of less than or equal to 25% by weight.

5. The surfactant composition of claim 2, wherein said low 2-phenyl alkylbenzene sulfonate is a linear alkylbenzene sulfonate having a 2-phenyl isomer content of up to about 20% by weight.

6. The surfactant composition of claim 4, wherein a cation of said low 2-phenyl alkylbenzene sulfonate comprises at least one of ammonium, a substituted ammonium, an alkali metal, an alkaline earth metal, or a mixture thereof.

7. The surfactant composition of claim 6, wherein said alkali metal comprises sodium.

8. The surfactant composition of claim 4, wherein said ethylene oxide/propylene oxide block copolymer has an ethylene oxide content of from greater than about 15% to about 70% by weight of the copolymer molecule.

9. The surfactant composition of claim 4, wherein said ethylene oxide/propylene oxide block copolymer has an ethylene oxide content of from about 20% to about 70% by weight of the copolymer molecule.

10. The surfactant composition of claim 4, wherein said low 2-phenyl alkylbenzene sulfonate is present in an amount of from about 15% to about 30% by total weight of said composition, and wherein said ethylene oxide/propylene oxide solubility enhancer is present in an amount of from about 0.8% to about 8% by total weight of said composition.

11. The surfactant composition of claim 4, having a reduction in clear point of between about 5° C. and about 35° C.

12. A surfactant composition consisting of a solvent, ethylene oxide/propylene oxide solubility enhancer and linear alkylbenzene sulfonate, said linear alkylbenzene sulfonate having a 2-phenyl isomer content of from about 14% to 25% by weight; and wherein said alkylbenzene sulfonate is present in an amount of from about 2% to about 40% by total weight of said composition;

wherein said ethylene oxide/propylene oxide solubility enhancer is present in an amount of from about 0.2% to about 10% by total weight of said composition;

wherein said ethylene oxide/propylene oxide block copolymer has an ethylene oxide content of from greater than about 15% to about 80% by weight of the copolymer molecule;

wherein said surfactant composition is all aqueous solution;

wherein said ethylene oxide/propylene oxide block copolymer has the fomiula:

$$HO[CH_2CH_2O]_x[CH_2\overset{CH_3}{\overset{|}{C}}HO]_y[CH_2CH_2O]_zH;\text{ and}$$

wherein x is between about 3.5 and about 150, y is between about 16 and about 70, and z is between about 3.5 and about 150.

13. The surfactant composition of claim 12, wherein said ethylene oxide/propylene oxide block copolymer has an ethylene oxide content of from 20% to about 70% by weight of the molecule.

14. The surfactant composition of claim 12, wherein said solvent comprises at least one of water, alcohol, glycol, glycol ether, or a mixture thereof.

15. The surfactant composition of claim 14, wherein said solvent comprises at least one of water, alcohol having from 1 to about 6 carbon atoms, or a mixture thereof.

16. The surfactant composition of claim 12, wherein an alkyl chain of said alkylbenzene sulfonate surfactant contains from about 8 to about 16 carbon atoms.

17. The surfactant composition of claim 12, wherein a cation of said alkylbenzene sulfonate surfactant comprises sodium.

18. The surfactant composition of claim 12, wherein a cloud point of said surfactant composition is from about 17° C. to about −10° C.

19. The surfactant composition of claim 12, wherein a clear point of said surfactant solution is from about 23° C. to about −5° C.

20. The surfactant composition of claim 12, having a reduction in cloud point of between about 10° C. and about 38° C.

21. The surfactant composition of claim 12, having a reduction in clear point of between about 5° C. and about 35° C.

22. A surfactant composition consisting of from about 2% to about 40% low 2-phenyl linear alkylbenzene sulfonate by total weight of the composition; from about 0.2% to about 8% ethylene oxide/propylene oxide block co-polymer by total weight of the composition; and from about 97.8% to about 52% solvent by total weight of the composition;

wherein said solvent comprises at least one of water, alcohol containing from 1 to about 6 carbon atoms, or a mixture thereof;

wherein an alkyl chain of said low 2-phenyl linear alkylbenzene sulfonate surfactant contains from about 8 to about 16 carbon atoms;

wherein said surfactant composition is a liquid solution; and wherein said ethylene oxide/propylene oxide block copolymer has an ethylene oxide content of from about 20% to about 80% by weight of the copolymer molecule, and a propylene oxide content of from about 20% to less than about 80% by weight of the copolymer molecule, and wherein said ethylene oxide/propylene oxide block copolymer is represented by the formula:

$$HO[CH_2CH_2O]_x[CH_2\overset{CH_3}{\overset{|}{C}}HO]_y[CH_2CH_2O]_zH;\text{ and}$$

wherein x is between about 3.5 and about 150, y is between about 16 and about 70, and z is between about 3.5 and about 150.

23. The surfactant composition of claim 22, wherein the cloud point of said surfactant composition is from about 17° C. to about −10° C.; or wherein the clear point of said surfactant composition is from about 23° C. to about −5° C.

24. The surfactant composition of claim 22, having a reduction in cloud point of between about 10° C. and about 38° C.; or having a reduction in clear point of between about 5° C. and about 35° C.

25. The surfactant composition of claim 22, wherein a cation of said low 2-phenyl linear alkylbenzene sulfonate surfactant comprises sodium.

26. A method of enhancing solubility of low 2-phenyl alkylbenzene sulfonate in a solvent, said method comprising:

preparing a liquid solution consisting of said low 2-phenyl alkylbenzene sulfonate, said solvent, and ethylene oxide/propylene oxide block co-polymer;

wherein said ethylene oxide/propylene oxide block co-polymer has a content of ethylene oxide greater than 15% by weight of the molecule;

wherein said solvent comprises water; and wherein said liquid solution has a clear point of less than or equal to about 20° C.

27. The method of claim 26, wherein said ethylene oxide/propylene oxide block copolymer has the formula:

$$HO[CH_2CH_2O]_x[CH_2\overset{CH_3}{\overset{|}{C}}HO]_y[CH_2CH_2O]_zH;\text{ and}$$

wherein x is between about 3.5 and about 150, y is between about 16 and about 70, and z is between about 3.5 and about 150.

28. The method of claim 27, wherein said low 2-phenyl alkylbenzene sulfonate has a 2-phenyl isomer content of less than or equal to 25% by weight.

29. The method of claim 27, wherein said low 2-phenyl alkylbenzene sulfonate has a 2-phenyl isomer content of up to about 20% by weight.

30. The method of claim 28, wherein an alkyl chain of said low 2-phenyl alkylbenzene sulfonate has from about 8 to about 16 carbon atoms.

31. The method of claim 28, wherein a cation of said low 2-phenyl alkylbenzene sulfonate comprises sodium.

32. The method of claim 28, wherein said ethylene oxide/propylene oxide block copolymer has an ethylene oxide content of from greater than about 15% to about 80% by weight of the copolymer molecule.

33. The method of claim 28, wherein said ethylene oxide/propylene oxide block copolymer has an ethylene oxide content from about 20% to about 80% by weight of the copolymer molecule.

34. The method of claim 28, wherein said ethylene oxide/propylene oxide block copolymer has an ethylene oxide content from about 20% to about 70% by weight of the copolymer molecule.

35. The method of claim 30, wherein said preparing comprises preparing a liquid solution with a sufficient amount of ethylene oxide/propylene oxide block co-polymer to result in a solution consisting of from about 2% to about 40% low 2-phenyl alkylbenzene sulfolnate by total weight of the solution; and from about 0.2% to about 8% ethylene oxide/propylene oxide block co-polymer by total weight of the solution.

36. The method of claim 28, wherein said preparing comprises:

adding an ethylene oxide/propylene oxide to said liquid solution; and lowering the cloud point of said liquid solution to from about 17° C. to about −10° C., or lowering the clear point of said liquid solution to from about 23° C. to about −5° C.

37. The method of claim 28, wherein said preparing comprises:

adding an ethylene oxide/propylene oxide to said liquid solution; and lowering the cloud point of said liquid solution to between about 10° C. and about −7° C.; or reducing the clear point of said liquid solution to between about 10° C. and about −1° C.

38. A surfactant composition consisting of:

at least one low 2-phenyl linear alkylbenzene sulfonate at least one solvent; and at least one ethylene oxide/propylene oxide block co-polymer solubility enhancer;

wherein said ethylene oxide/propylene oxide block co-polymer has a content of ethylene oxide greater than 15% by weight of the molecule;

wherein said surfactant composition is an aqueous solution; and wherein said ethylene oxide/propylene oxide block co-polymer solubility enhancer is present in an amount effective to lower a cloud point of said surfactant composition to less than 5° C.

39. The surfactant composition of claim 38, wherein said ethylene oxide/propylene oxide block co-polymer solubility enhancer is present in an amount effective to lower a cloud point of said surfactant composition to less than or equal to about 0° C.

40. The surfactant composition of claim 38, wherein said ethylene oxide/propylene oxide block co-polymer solubility enhancer is present in an amount effective to lower a cloud point of said surfactant composition to from less than about 5° C. to about −9.9° C.

41. The surfactant composition of claim 38, wherein said ethylene oxide/propylene oxide block co-polymer solubility enhancer is present in an amount effective to lower a cloud point of said surfactant composition to from about 3° C. to about −5° C.

42. The surfactant composition of claim 38, wherein said ethylene oxide/propylene oxide block co-polymer solubility enhancer is present in an amount effective to lower a cloud point of said surfactant composition to from less than about 0° C. to about −9.9° C.

43. The surfactant composition of claim 40, wherein said low 2-phenyl linear alkylbenzene sulfonate is present in an amount from about 2% to about 40% by total weight of said composition, wherein said ethylene oxide/propylene oxide block co-polymer solubility enhancer is present in an amount from about 0.2% to about 10% by total weight of said composition; and wherein a solvent is present in an amount of from about 50% and about 97.8%.

* * * * *